US010189290B2

(12) United States Patent
Kanda

(10) Patent No.: US 10,189,290 B2
(45) Date of Patent: Jan. 29, 2019

(54) PRINTER AND RECORDING MEDIUM

(71) Applicant: BROTHER KOGYO KABUSHIKI KAISHA, Nagoya-shi, Aichi (JP)

(72) Inventor: Mitsuhiro Kanda, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/715,278

(22) Filed: Sep. 26, 2017

(65) Prior Publication Data

US 2018/0093514 A1 Apr. 5, 2018

(30) Foreign Application Priority Data

Sep. 30, 2016 (JP) ..... 2016-193190

(51) Int. Cl.

| | |
|---|---|
| ***B41J 2/32*** | (2006.01) |
| ***B41J 29/377*** | (2006.01) |
| ***B41J 29/02*** | (2006.01) |
| ***B41J 29/13*** | (2006.01) |

(52) U.S. Cl.

CPC ..... *B41J 29/377* (2013.01); *B41J 2/32* (2013.01); *B41J 29/02* (2013.01); *B41J 29/13* (2013.01)

(58) Field of Classification Search

CPC ... B41J 29/377; B41J 29/38; B41J 2/32; B41J 2/04563; B41J 2/365; B41J 2/0454; B41J 2/3358; B41J 2/355; B41J 2/3551; B41J 2/3558; B41J 2/36; B41J 2/362; B41J 2/375; B41J 2202/30

See application file for complete search history.

(56) References Cited

U.S. PATENT DOCUMENTS

| | | | | |
|---|---|---|---|---|
| 9,259,929 | B2 * | 2/2016 | Hanagami | B41J 2/14233 |
| 2005/0232674 | A1 * | 10/2005 | Kakegawa | B41J 13/0027 400/319 |
| 2011/0012979 | A1 * | 1/2011 | Kitamura | B41J 2/325 347/218 |

FOREIGN PATENT DOCUMENTS

| | | | |
|---|---|---|---|
| JP | H05-294021 | A | 11/1993 |
| JP | 2000-158755 | A | 6/2000 |

* cited by examiner

*Primary Examiner* — Geoffrey S Mruk
*Assistant Examiner* — Scott A Richmond
(74) *Attorney, Agent, or Firm* — Scully, Scott, Murphy & Presser, P.C.

(57) ABSTRACT

The disclosure discloses a printer configured to perform a forcible a first discontinuation control process, a first resuming control process, a second discontinuation control process, and a second resuming control process. In the first discontinuation control process, the printing is discontinued to execute forcible cooling when the detected temperature reaches a forcible cooling temperature. In the first resuming control process, the printing is resumed while doubly forming dots on the print line a print-receiving medium when the detected temperature is decreased to a forcible cooling cancellation temperature after a start of an execution of the forcible cooling. In the second discontinuation control process, the printing is discontinued to execute between-page cooling when the detected temperature reaches a between-page cooling temperature. In the second resuming control process, the printing is resumed when the detected temperature is decreased to between-page cooling cancellation temperature.

8 Claims, 13 Drawing Sheets

[FIG. 1]
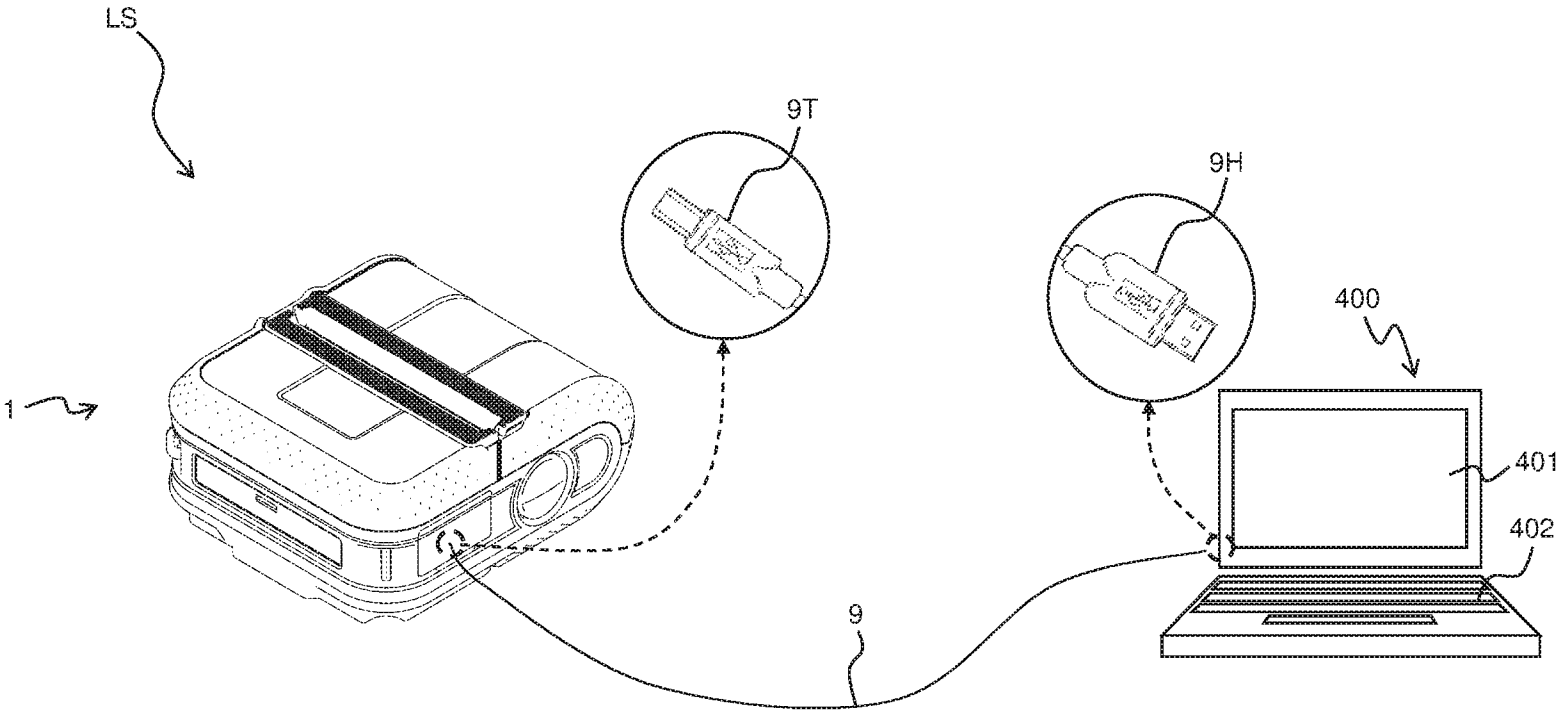

[FIG. 2]
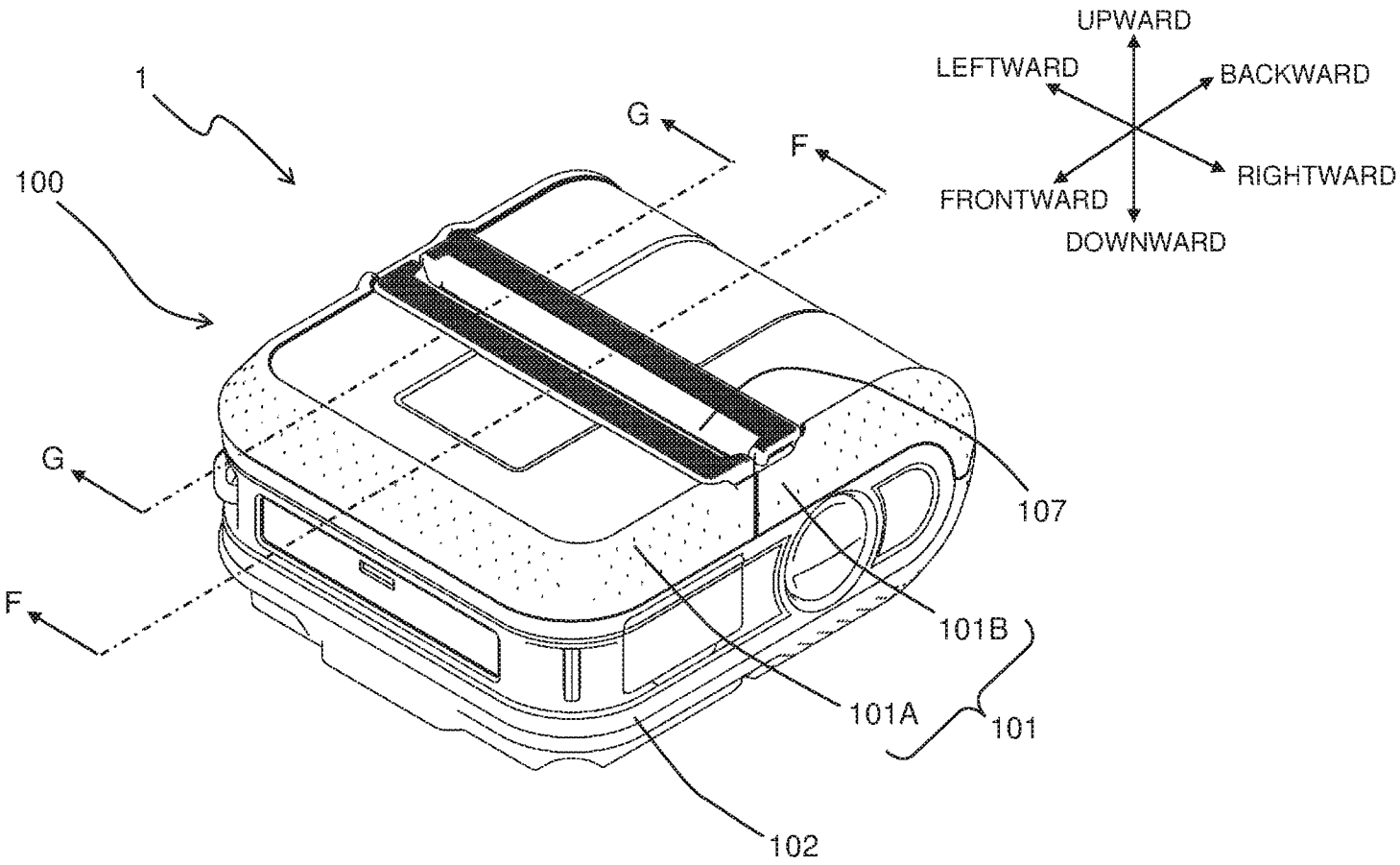

[FIG. 3]
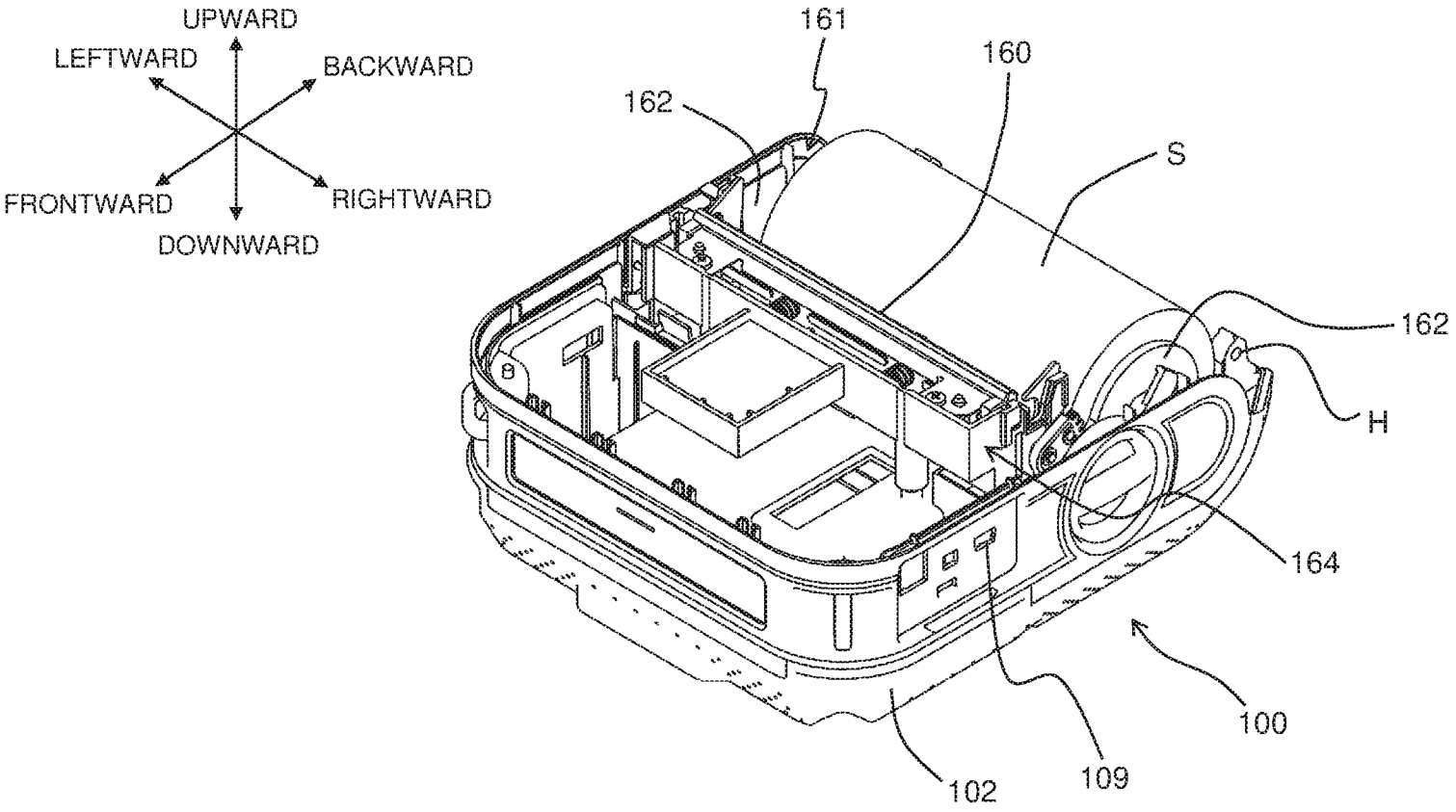

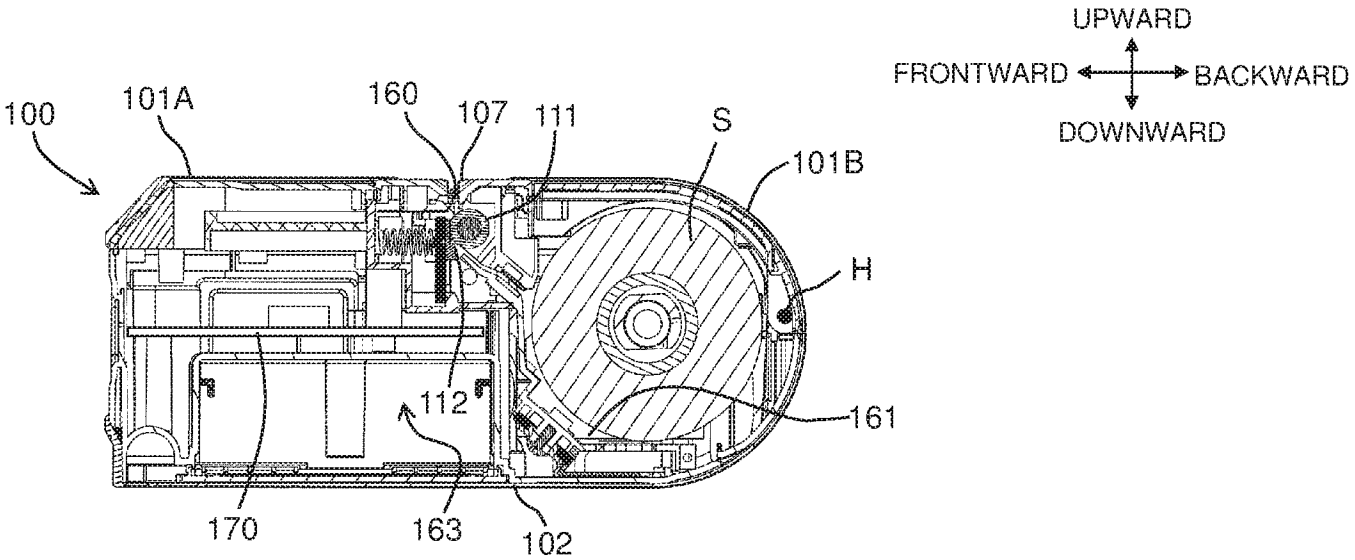
[FIG. 4A]
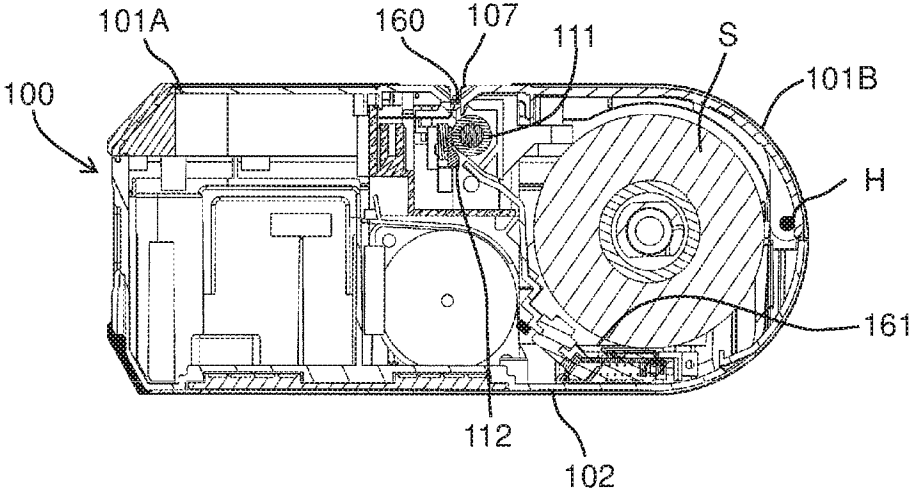
[FIG. 4B]

[FIG. 5]
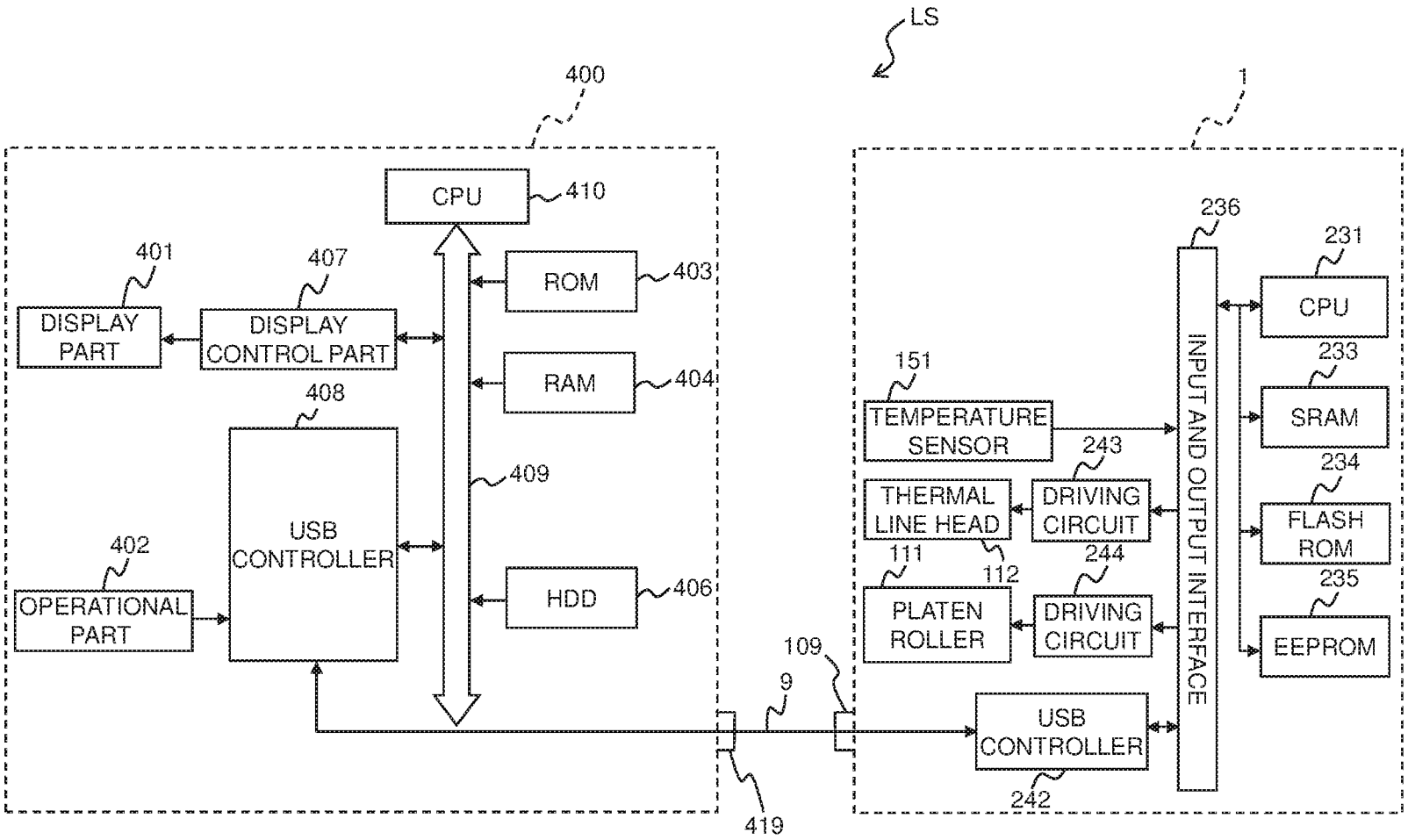

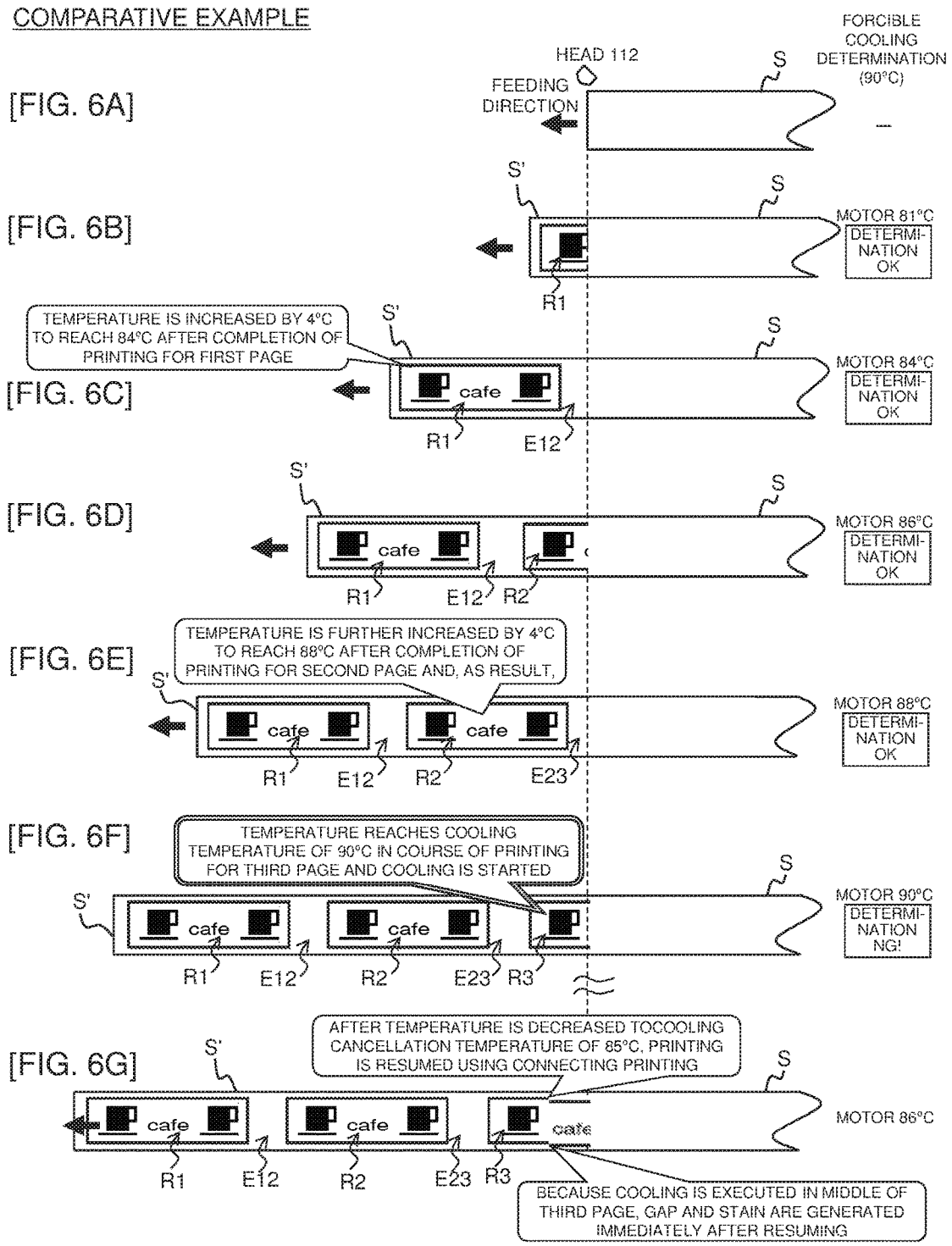
COMPARATIVE EXAMPLE
[FIG. 6A]
HEAD 112
FEEDING DIRECTION
S
FORCIBLE COOLING DETERMINATION (90°C)
[FIG. 6B]
S'
S
MOTOR 81°C
DETERMI-NATION OK
R1
[FIG. 6C]
TEMPERATURE IS INCREASED BY 4°C TO REACH 84°C AFTER COMPLETION OF PRINTING FOR FIRST PAGE
S'
S
cafe
MOTOR 84°C
DETERMI-NATION OK
R1
E12
[FIG. 6D]
S'
S
cafe
MOTOR 86°C
DETERMI-NATION OK
R1
E12
R2
[FIG. 6E]
TEMPERATURE IS FURTHER INCREASED BY 4°C TO REACH 88°C AFTER COMPLETION OF PRINTING FOR SECOND PAGE AND, AS RESULT,
S'
cafe
cafe
MOTOR 88°C
DETERMI-NATION OK
R1
E12
R2
E23
[FIG. 6F]
TEMPERATURE REACHES COOLING TEMPERATURE OF 90°C IN COURSE OF PRINTING FOR THIRD PAGE AND COOLING IS STARTED
S'
S
cafe
cafe
MOTOR 90°C
DETERMI-NATION NG!
R1
E12
R2
E23
R3
[FIG. 6G]
AFTER TEMPERATURE IS DECREASED TOCOOLING CANCELLATION TEMPERATURE OF 85°C, PRINTING IS RESUMED USING CONNECTING PRINTING
S'
S
cafe
cafe
cafe
MOTOR 86°C
R1
E12
R2
E23
R3
BECAUSE COOLING IS EXECUTED IN MIDDLE OF THIRD PAGE, GAP AND STAIN ARE GENERATED IMMEDIATELY AFTER RESUMING EMBODIMENT
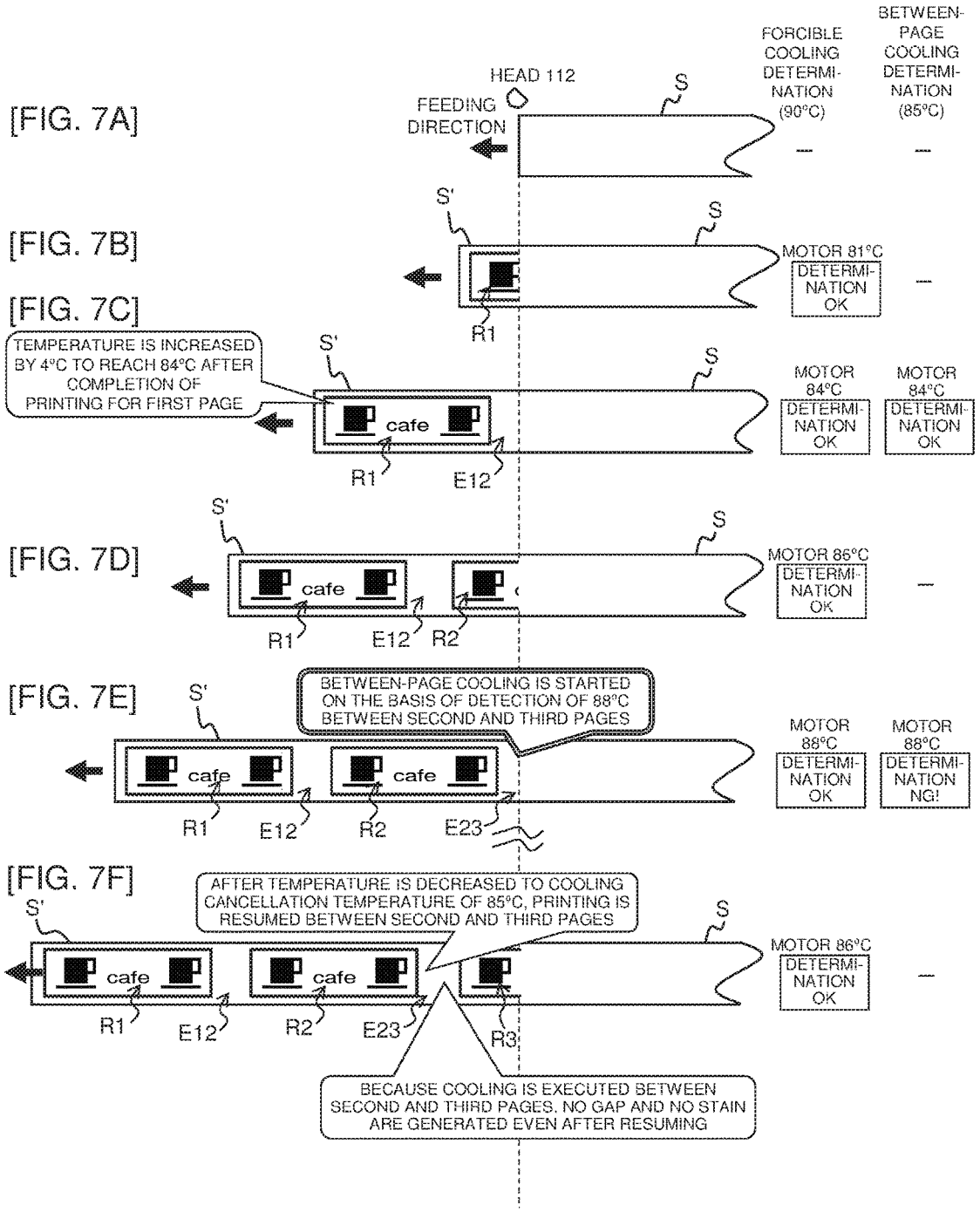

[FIG. 8]
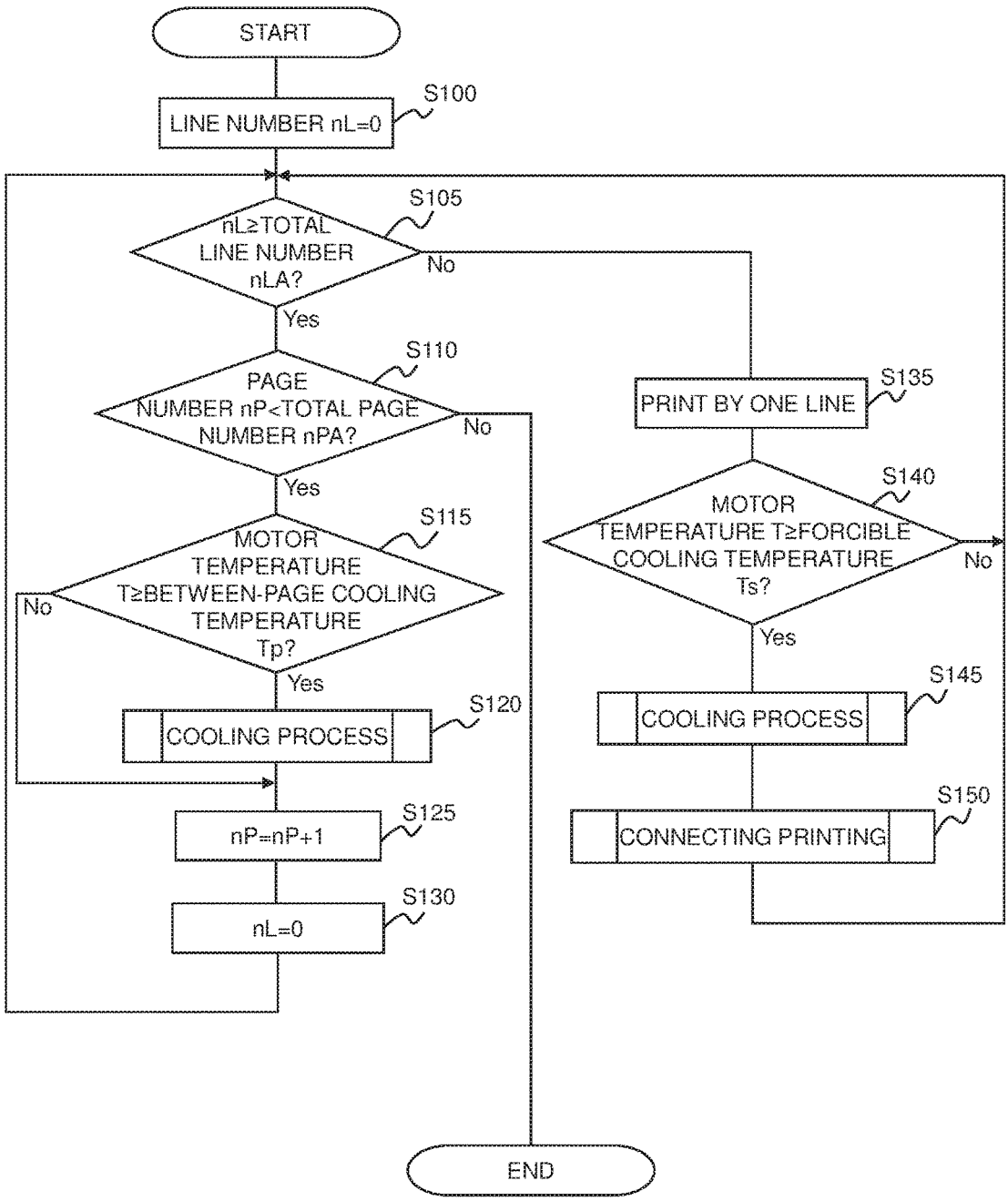

[FIG. 9A]
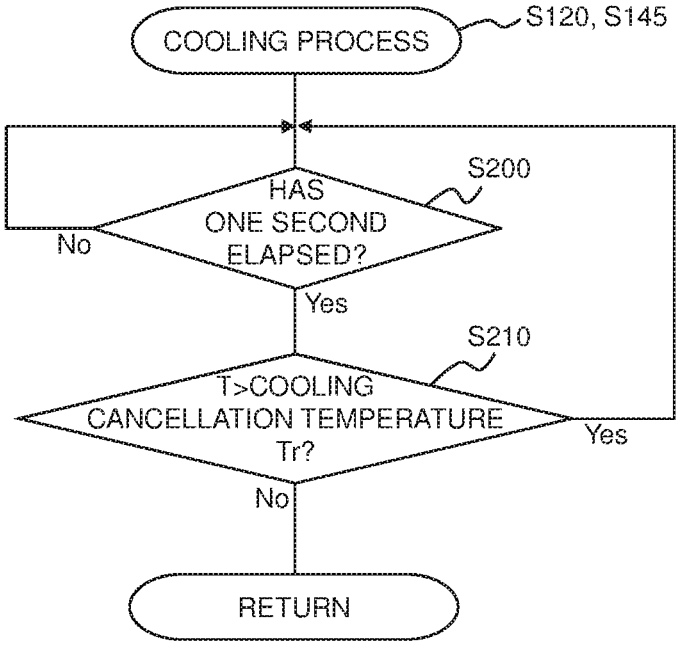
[FIG. 9B]
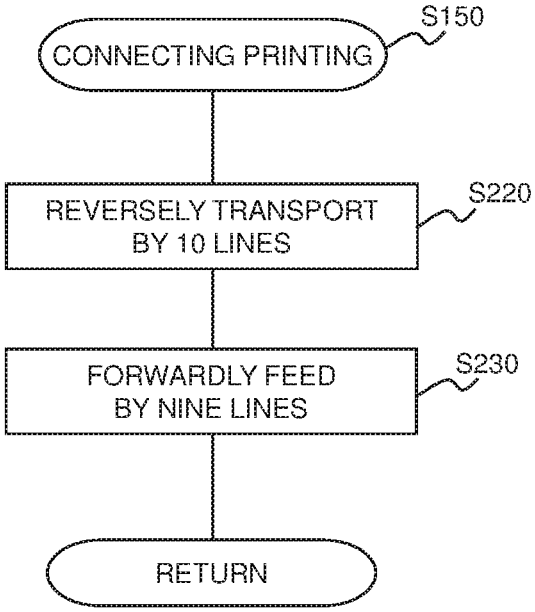

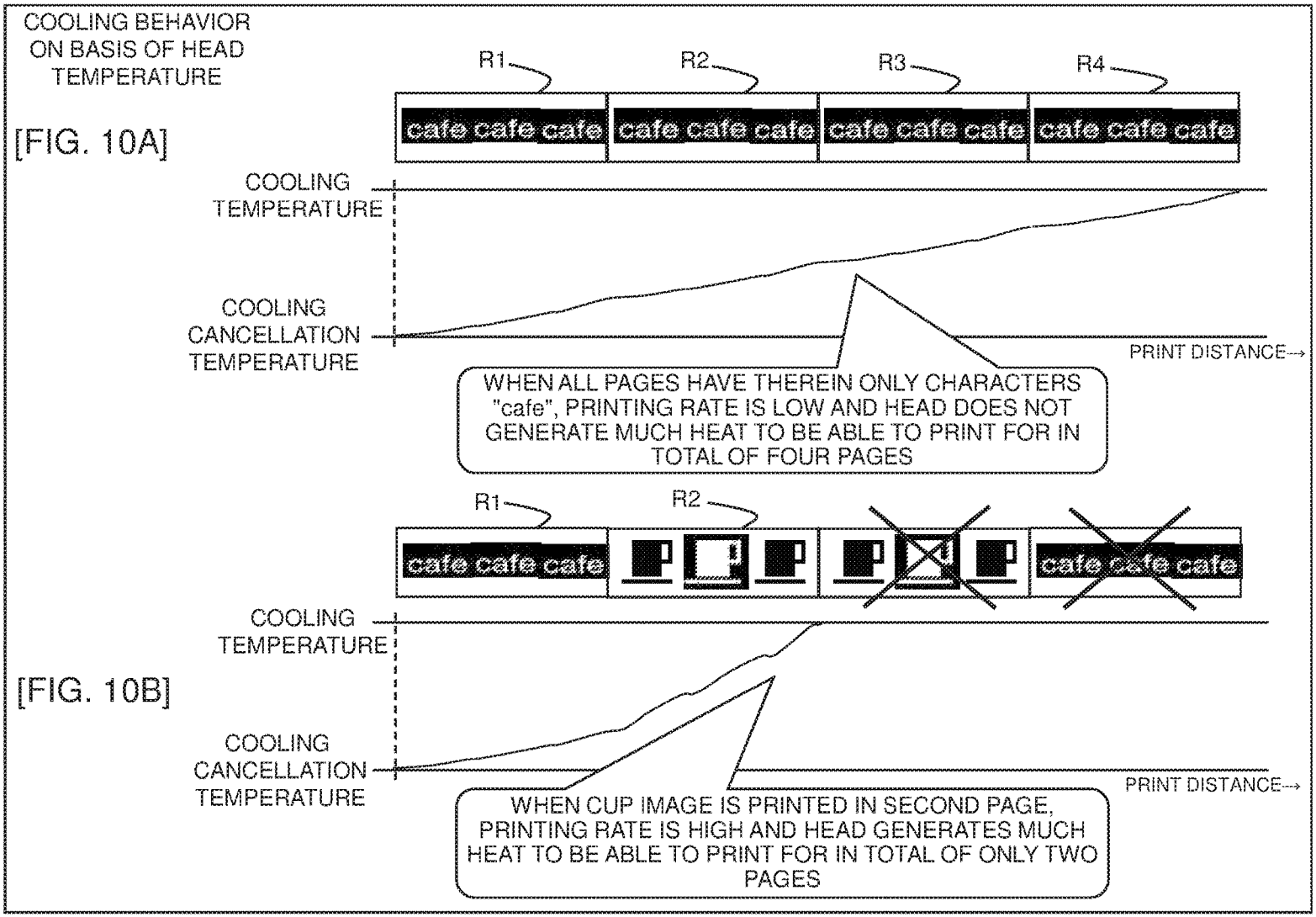
COOLING BEHAVIOR ON BASIS OF HEAD TEMPERATURE
[FIG. 10A]
R1
R2
R3
R4
cafe
COOLING TEMPERATURE
COOLING CANCELLATION TEMPERATURE
PRINT DISTANCE→
WHEN ALL PAGES HAVE THEREIN ONLY CHARACTERS "cafe", PRINTING RATE IS LOW AND HEAD DOES NOT GENERATE MUCH HEAT TO BE ABLE TO PRINT FOR IN TOTAL OF FOUR PAGES
[FIG. 10B]
R1
R2
cafe
COOLING TEMPERATURE
COOLING CANCELLATION TEMPERATURE
PRINT DISTANCE→
WHEN CUP IMAGE IS PRINTED IN SECOND PAGE, PRINTING RATE IS HIGH AND HEAD GENERATES MUCH HEAT TO BE ABLE TO PRINT FOR IN TOTAL OF ONLY TWO PAGES

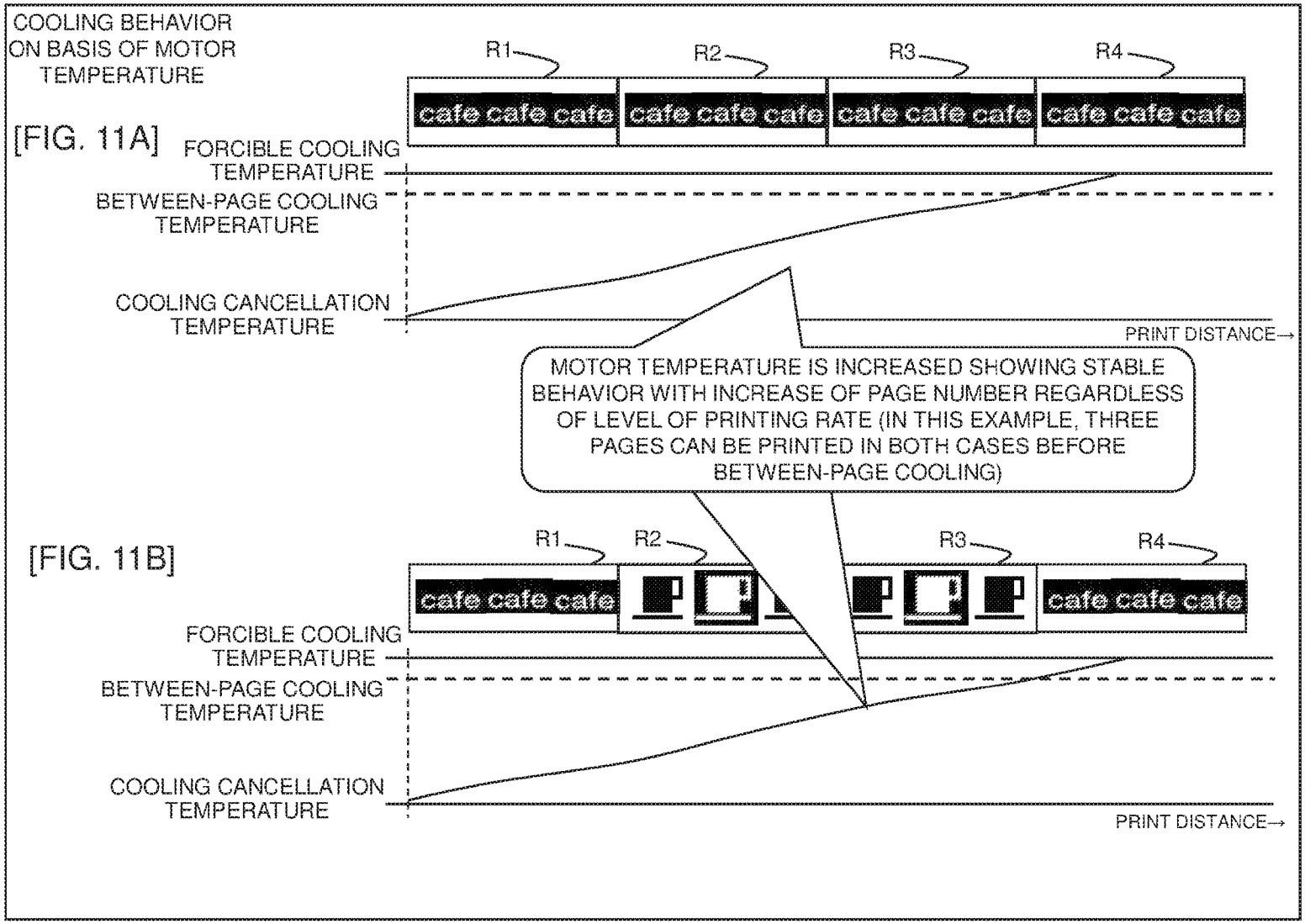
COOLING BEHAVIOR ON BASIS OF MOTOR TEMPERATURE
[FIG. 11A]
R1
R2
R3
R4
cafe cafe cafe
FORCIBLE COOLING TEMPERATURE
BETWEEN-PAGE COOLING TEMPERATURE
COOLING CANCELLATION TEMPERATURE
PRINT DISTANCE→
MOTOR TEMPERATURE IS INCREASED SHOWING STABLE BEHAVIOR WITH INCREASE OF PAGE NUMBER REGARDLESS OF LEVEL OF PRINTING RATE (IN THIS EXAMPLE, THREE PAGES CAN BE PRINTED IN BOTH CASES BEFORE BETWEEN-PAGE COOLING)
[FIG. 11B]
R1
R2
R3
R4
cafe cafe cafe
FORCIBLE COOLING TEMPERATURE
BETWEEN-PAGE COOLING TEMPERATURE
COOLING CANCELLATION TEMPERATURE
PRINT DISTANCE→

MODIFICATION EXAMPLE
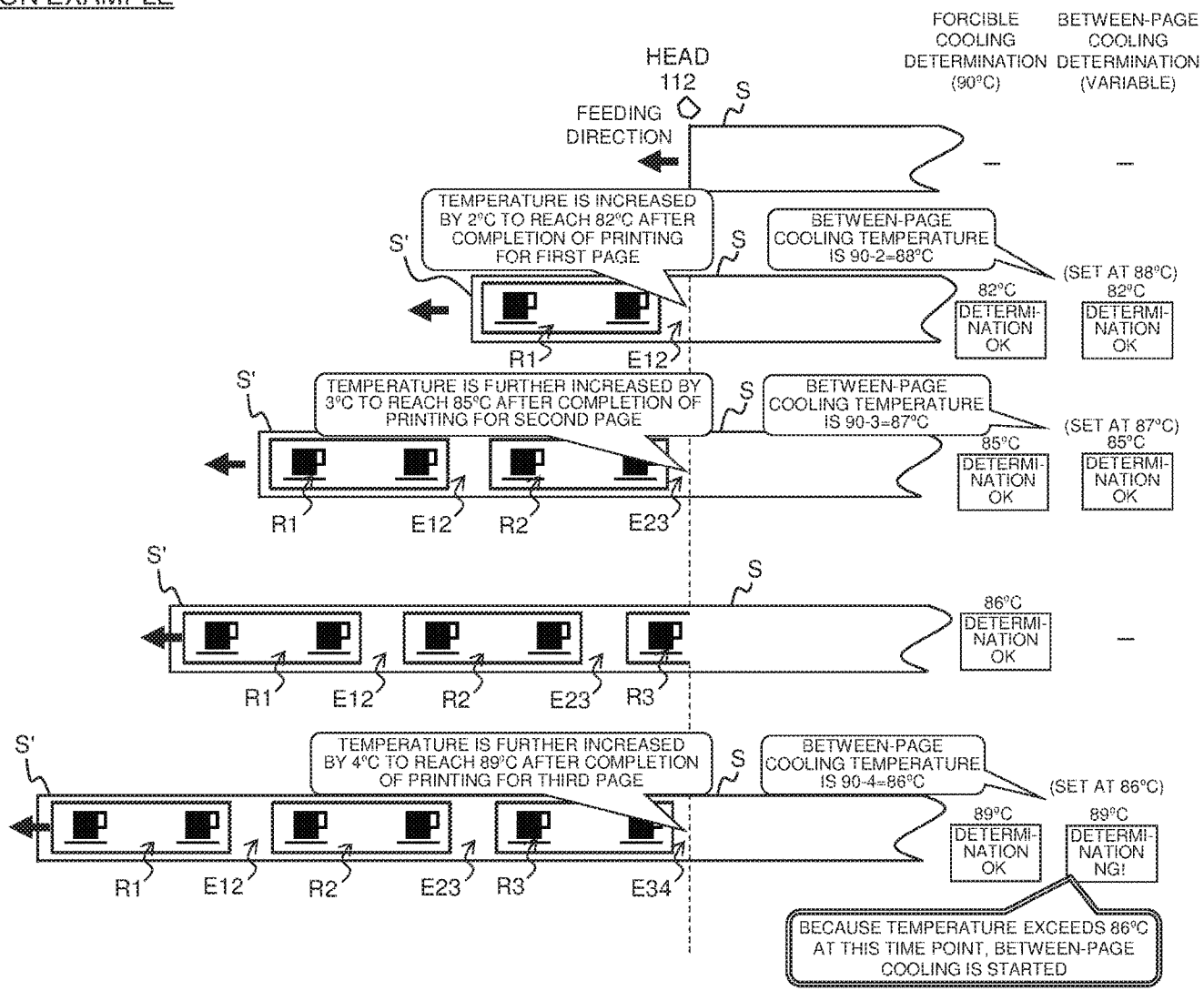
[FIG. 12A]
[FIG. 12B]
[FIG. 12C]
[FIG. 12D]
[FIG. 12E]

[FIG. 13]
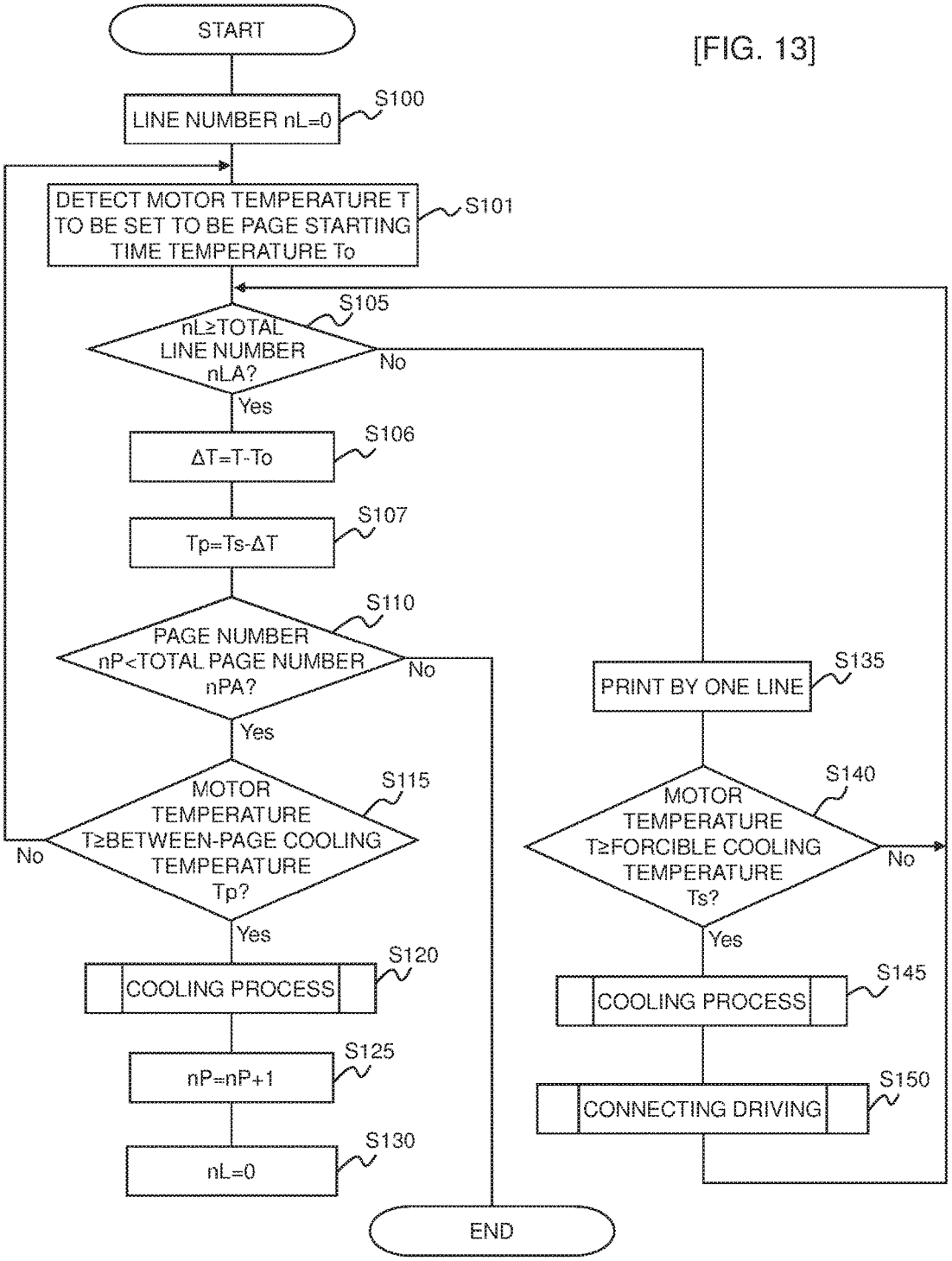

PRINTER AND RECORDING MEDIUM

CROSS-REFERENCE TO RELATED APPLICATION

The present application claims priority from Japanese Patent Application No. 2016-193190, which was filed on Sep. 30, 2016, the disclosure of which is incorporated herein by reference in its entirety.

BACKGROUND

Field

The present disclosure relates to a printer that executes what-is-called "cooling" in accordance with a detected temperature, and a recording medium that has a printing process program recorded thereon.

Description of the Related Art

A printer that executes what-is-called "cooling" in accordance with a detected temperature when the printer executes printing for a print-receiving medium that has plural pages is already known. When a detected temperature of a proper point (for example, a printing head) in the printer, that is detected by a proper temperature detector reaches a predetermined cooling temperature, transporting by a transport roller and print formation by the printing head are discontinued. When the detected temperature is subsequently decreased to a predetermined cooling cancellation temperature to cancel the cooling, the transporting by the transport roller and the print formation by the printing head are resumed.

With the above technique, because the printing is immediately discontinued at the timing at which the detected temperature reaches the cooling temperature, the printing may be discontinued in the course of the print formation in a print area of each of the pages of the print-receiving medium. In this case, when the printing is resumed as above, a gap or a non-printed portion (a white line) may be generated in the middle of the print content (such as a character or an icon) during the formation thereof because of an unavoidable error in relation to the mechanical precision•control precision to degrade the print quality.

To avoid this, a technique of, when the printing is resumed, doubly forming the dots in the print line on the print-receiving medium, in which the dots are formed last immediately before the discontinuation of the printing, for resuming the printing (what-is-called "connecting printing") is known.

The gap in the middle of the print content may however be generated to degrade the print quality even when the connecting printing such as that of the prior art is executed, and this connecting printing is not necessarily satisfying from the viewpoint of securing the excellent print quality.

SUMMARY

An object of the present disclosure is to provide a configuration capable of reliably preventing any degradation of the print quality of a printer that executes cooling, and a recording medium that has a printing process program in accordance with the configuration recorded thereon.

In order to achieve the above-described object, according to the aspect of the present application, there is provided a printer comprising a feeding roller configured to feed a print-receiving medium that has plural pages arranged on the print-receiving medium along a length direction of the print-receiving medium, each of the pages including a print area, and has non-print areas each disposed between respective two adjacent pages of the plural pages, a driving motor configured to drive the feeding roller, and a printing head including plural heat generating elements that is arranged along a direction perpendicular to a feeding direction of the feeding roller and is configured to form at least dots in each print line formed by dividing the print-receiving medium in the feeding direction at a print resolution, the printing head being configured to form a print on the print-receiving medium, the printer being configured to sequentially execute printing using the feeding roller and the printing head in cooperation with each other for each of the plural pages of the print-receiving medium, the printer further comprising a motor temperature detector configured to detect a temperature of the driving motor, a processor, and a first memory, the first memory storing computer-executable instructions that, when executed by the processor, cause the printer to perform a forcible cooling determination process for determining whether a detected temperature detected by the motor temperature detector reaches a forcible cooling temperature predetermined in advance in a state that the printing head executes the printing on the print area, a first discontinuation control process for discontinuing the printing to execute forcible cooling, by controlling the printing head and the feeding roller at a timing that it is determined that the detected temperature reaches the forcible cooling temperature by the forcible cooling determination process, a first resuming control process for resuming the printing while doubly forming dots on the print line of the print-receiving medium on which dots are formed last at least immediately before discontinuing the printing by controlling the printing head and the feeding roller when the detected temperature is decreased to a forcible cooling cancellation temperature predetermined in advance after a start of an execution of the forcible cooling by the first discontinuation control process, a between-page cooling determination process for determining whether the detected temperature reaches a between-page cooling temperature that is lower than the forcible cooling temperature in a state that the printing head faces the non-print area, a second discontinuation control process for discontinuing the printing to execute between-page cooling, by controlling the printing head and the feeding roller in a state that the printing head faces the non-print area at a timing that it is determined that the detected temperature reaches the between-page cooling temperature by the between-page cooling determination process, and a second resuming control process for resuming the printing by controlling the printing head and the feeding roller when the detected temperature is decreased to between-page cooling cancellation temperature predetermined in advance after a start of an execution of the between-page cooling by the second discontinuation control process.

BRIEF DESCRIPTION OF THE DRAWINGS

FIG. 1 is a system configuration view showing the printing process system including a printer according to an embodiment of the present disclosure.

FIG. 2 is a perspective view showing the schematic configuration of the printer.

FIG. 3 is a perspective view showing the state of the printer shown in FIG. 2 where a top cover of a housing is removed, obliquely seen from above on the front side.

FIG. 4A is a cross-sectional view showing an F-F cross-section in FIG. 2.

FIG. 4B is a cross-sectional view showing a G-G cross-section in FIG. 2.

FIG. 5 is a functional block view showing the electrical configuration of an external terminal and the printer.

FIG. 6A is an explanatory view showing a printing behavior on the basis of Comparative Example where only forcible cooling is executed without executing any between-page cooling.

FIG. 6B is an explanatory view showing the printing behavior on the basis of Comparative Example where only the forcible cooling is executed without executing any between-page cooling.

FIG. 6C is an explanatory view showing the printing behavior on the basis of Comparative Example where only the forcible cooling is executed without executing any between-page cooling.

FIG. 6D is an explanatory view showing the printing behavior on the basis of Comparative Example where only the forcible cooling is executed without executing any between-page cooling.

FIG. 6E is an explanatory view showing the printing behavior on the basis of Comparative Example where only the forcible cooling is executed without executing any between-page cooling.

FIG. 6F is an explanatory view showing the printing behavior on the basis of Comparative Example where only the forcible cooling is executed without executing any between-page cooling.

FIG. 6G is an explanatory view showing the printing behavior on the basis of Comparative Example where only the forcible cooling is executed without executing any between-page cooling.

FIG. 7A is an explanatory view showing a printing behavior of an embodiment of the present disclosure.

FIG. 7B is an explanatory view showing the printing behavior of an embodiment of the present disclosure.

FIG. 7C is an explanatory view showing the printing behavior of an embodiment of the present disclosure.

FIG. 7D is an explanatory view showing the printing behavior of an embodiment of the present disclosure.

FIG. 7E is an explanatory view showing the printing behavior of an embodiment of the present disclosure.

FIG. 7F is an explanatory view showing the printing behavior of an embodiment of the present disclosure.

FIG. 8 is a flowchart showing control steps executed by a CPU of the printer.

FIG. 9A is a flowchart showing detailed steps of a cooling process.

FIG. 9B is a flowchart showing detailed steps of connecting driving.

FIG. 10A is an explanatory graph showing the behavior of the temperature of a printing head associated with progress of the printing.

FIG. 10B is an explanatory graph showing the behavior of the temperature of the printing head associated with the progress of the printing.

FIG. 11A is an explanatory graph showing the behavior of the temperature of a driving motor associated with the progress of the printing.

FIG. 11B is an explanatory graph showing the behavior of the temperature of the driving motor associated with the progress of the printing.

FIG. 12A is an explanatory view showing the printing behavior in a modification example where the between-page cooling temperature is set to be variable.

FIG. 12B is an explanatory view showing the printing behavior in the modification example where the between-page cooling temperature is set to be variable.

FIG. 12C is an explanatory view showing the printing behavior in the modification example where the between-page cooling temperature is set to be variable.

FIG. 12D is an explanatory view showing the printing behavior in the modification example where the between-page cooling temperature is set to be variable.

FIG. 12E is an explanatory view showing the printing behavior in the modification example where the between-page cooling temperature is set to be variable.

FIG. 13 is a flowchart showing control steps executed by the CPU.

DESCRIPTION OF THE PREFERRED EMBODIMENTS

An embodiment of the present disclosure will be described with reference to the drawings.

<Printing Process System>

A printing process system including a printer of this embodiment will be described with reference to FIG. 1.

In FIG. 1, in this printing process system LS, an external terminal 400 to operate a printer 1 (a printer) and the printer 1 that executes printing in accordance with print data received by the external terminal 400 are connected to each other by, in this example, a universal serial bus (USB) cable 9.

The external terminal 400 is, for example, a multi-purpose personal computer that is generally available commercially, and includes a display part 401 such as a liquid crystal display, and an operational part 402 that includes a keyboard, a mouse, and the like. A host socket 419 (see FIG. 5 described later) to attach thereto and detach therefrom a first connector 9H in an end portion of the USB cable 9 is disposed at a proper point (for example, in a back face portion) of the external terminal 400.

On a side face of the printer 1, a target socket 109 (see FIG. 3 described later) to attach thereto and detach therefrom a second connector 9T of an end portion on the side opposite to that of the first connector 9H of the USB cable 9 is disposed (see FIG. 3 described later).

The USB cable 9 includes the first connector 9H that causes a device connected thereto to function as a host and the second connector 9T that causes a device connected thereto to function as a target (see enlarged views in FIG. 1). In this example, as to the USB cable 9, the second connector 9T is attached (connected) to the target socket 109 (including a USB port therein) of the printer 1, and the first connector 9H is attached to the host socket 419 of the external terminal 400.

<Configuration of Printer>

The configuration of the printer 1 will be described with reference to FIG. 2 to FIG. 4. In FIG. 2 to FIG. 4, a lower right direction in FIG. 2 is defined as rightward, an upper left direction therein is defined as leftward, an upper right direction therein is defined as backward, a lower left direction therein is defined as frontward, an upward direction therein is defined as upward, and a downward direction therein is defined as downward (see arrows shown in each of FIG. 2 to FIG. 4).

As shown in FIG. 2 to FIG. 4, the printer 1 includes a substantially box-shaped housing 100 that constitutes the outer shell of the device. The housing 100 includes a top cover 101 that constitutes the upper portion of the outer shell of the device, and an under cover 2 that constitutes the lower portion of the outer shell of the device. The top cover 101 includes a fixed portion 101A and an opening and closing lid 101B.

A roll storage part 161 is disposed (inside the housing 100) downward the opening and closing lid 101B of the top cover 101 (see FIG. 3, FIG. 4). The roll storage part 161 has a wide-width tape-like roll paper sheet S (a print-receiving medium) that has plural pages each including a print area determined in advance arranged thereon in the tape length direction, stored therein with both end portions thereof axially supported rotatably by supporting members 162 and, as a result, the roll paper sheet S can continuously be supplied from the roll storage part 161. In this case, the opening and closing lid 101B is rotatably coupled to a back end portion of the under cover 102 through a hinge part H, and the roll storage part 161 can be exposed to the exterior of the device to enable easy attachment or easy replacement of the roll paper sheet S by setting the opening and closing lid 101B to be opened. A discharging exit 107 to discharge the roll paper sheet S after the printing therefor is disposed in a substantially central portion in the front-back direction of the top cover 101.

A platen roller 111 (a feeding roller; see FIG. 4) is rotatably supported in the end portion on the front side of the opening and closing lid 101B. The platen roller 111 feeds the roll paper sheet S when the opening and closing lid 101B is set to be closed.

For the roll paper sheet S fed as above, a thermal line head 112 (a printing head; see FIG. 3, FIG. 4) that is in contact with the platen roller 111 by a predetermined pressing contact force is disposed. In this case, though not shown in detail, the roll paper sheet S includes a thermal layer (a print-receiving layer) that develops a color by receiving a predetermined amount of heat, on its surface on the side with the thermal line head 112. When plural heat generating elements (not shown and arranged in the tape width direction perpendicular to the feeding direction) included in the thermal line head 112 are driven by a head driving circuit 243 (see FIG. 5 described later) to generate heat, the thermal layer receives the predetermined amount of heat from the heat generating elements and, as a result, the thermal layer develops a color. In this manner, dots are formed by the heat generating elements (on a print line formed by dividing the roll paper sheet S at the print resolution in the feeding direction). As a result, a desired print is formed on the roll paper sheet S.

In this case, a driving motor (not shown) generating a driving force to drive and rotate the platen roller 111 is disposed inside the housing 100 and, when the opening and closing lid 101B is closed, the driving force of the motor is transmitted to the platen roller 111 by a gear mechanism not shown. The driving of the driving motor is controlled by a roller driving circuit 244 (see FIG. 5 described later) disposed on a control circuit board 170 (see FIG. 4A) arranged extending backward inside the housing 100. A battery power source storage part 163 (see FIG. 4A) into which a battery power source is inserted to be arranged therein from the lower face side of the under cover 102 is disposed downward the control circuit board 170 in the housing 100.

<Outlined Operation of Printer>

With the above configuration, when the printing is executed, the print data is transmitted by the external terminal 400 to the printer 1 through the USB cable attached to the target socket 109 (see FIG. 3) disposed in the under cover 102. The roll paper sheet S is fed out from the roll storage part 161 by the rotation of the platen roller 111 on the basis of the driving force of the driving motor. The fed out roll paper sheet S is inserted between the thermal line head 112 and the platen roller 111 to pass therethrough, and printing in the desired form on the basis of the print data is executed by the heat generating elements of the thermal line head 112 for the roll paper sheet S. The roll paper sheet S after the printing is discharged from the discharging exit 107 to the exterior of the housing 100. In this case, a fixed blade 160 is attached along the discharging exit 107 inside the discharging exit 107 to a main chassis member 164 (see FIG. 3) disposed in the housing 100. An operator can manually cut off an end portion of the roll paper sheet S whose printing is completed as above and that is discharged from the discharging exit 107, using the fixed blade 160.

<Electrical Configuration>

The electrical configuration of each of the external terminal 400 and the printer 1 of the above configuration will be described with reference to FIG. 5.

<Electrical Configuration of Printer>

As shown in FIG. 5, the printer 1 includes a CPU 231 that supervises the control for the overall device, a flash ROM 234 that has control programs (including a printing process program to execute the process shown in FIG. 8, FIG. 9 described later) and the like stored therein, that is rewritable, and that is a non-volatile storage element storing therein data not erased even when the power is turned off, an SRAM 233 that is a volatile storage element storing therein temporary data and the like generated when the CPU 231 executes the control program, and an EEPROM 235 that is a non-volatile storage element properly storing therein parameter information, history information, and the like of the printer 1. The CPU 231, and the flash ROM 234, the SRAM 233, and the EEPROM 235 are connected to each other through a bus such that the CPU 231 can refer to the pieces of information stored in the flash ROM 234, the SRAM 233, and the EEPROM 235.

The printer 1 also includes an input and output interface 236. The input and output interface 236 is inserted between the CPU 231 and various devices (a head driving circuit 243, a roller driving circuit 244, a USB controller 242, and a temperature sensor 151 described later) connected to the CPU 231. Signals output from the CPU 231 to the various devices are made recognizable for the various devices and signals transmitted from the various devices to the CPU 231 are made recognizable for the CPU 231 by executing a voltage conversion process, an impedance conversion process, a timing adjustment process, and the like each between an input signal and an output signal.

The printer 1 also includes the head driving circuit 243 capable of controlling energizing for the heat generating elements of the thermal line head 112. The head driving circuit 243 is electrically connected to the thermal line head 112 to control the thermal line head 112 to enable the thermal line head 112 to print the print data on the roll paper sheet S. The head driving circuit 243 is electrically connected to the input and output interface 236 to be capable of being controlled by the CPU 231.

Though not shown in FIG. 1-FIG. 4, the temperature sensor 151 (a motor temperature detector) having a known configuration and capable of detecting the temperature of the driving motor is disposed. The result of the detection by the temperature sensor 151 is input into the CPU 231 through the input and output interface 236.

The printer 1 also includes the roller driving circuit 244 capable of controlling the driving of the platen roller 111 by the driving motor. The roller driving circuit 244 is electrically connected to the driving motor to control the platen roller 111 to enable the platen roller 111 to feed the roll paper sheet S during the printing of the print data onto the roll paper sheet S by the thermal line head 112. The roller driving circuit 244 is also electrically connected to the input and output interface 236 to be capable of being controlled by the CPU 231.

The printer 1 also includes the USB controller 242. The USB controller 242 is a controller device to execute the voltage conversion process and the impedance conversion process to enable communication with the external terminal 400 through the USB cable 9 attached to the target socket 109. The USB controller 242 and the input and output interface 236 are electrically connected to each other to make the signals received from the external terminal 400 through the USB cable 9 recognizable for the CPU 231 or to enable transmission of the signals transmitted from the CPU 231, to the external terminal 400 through the USB cable 9.

The CPU 231, the SRAM 233, the flash ROM 234, the EEPROM 235, the head driving circuit 243, the roller driving circuit 244, the USB controller 242, and the like are disposed on the control circuit board 170.

<Electrical Configuration of External Terminal>

The electrical configuration of the external terminal 400 will be described. The external terminal 400 includes a CPU 410 that supervises the control for the overall external terminal 400, a ROM 403 that has a BIOS program read in the starting up of the CPU 410, and the like stored therein, a hard disc drive (HDD) 406 that has an OS, executable files for applications, and the like stored thereon, a RAM 404 that is a volatile storage element having temporary data necessary when the OS and the applications are executed by the CPU 410, and the like stored therein, and the like. The ROM 403, the RAM 404, and the HDD 406 are connected to the CPU 410 through a bus 409 such that the CPU 410 can refer to the information stored in the ROM 403, the RAM 404, and the HDD 406.

The external terminal 400 also includes a display control part 407. The display control part 407 includes a display RAM (not shown) that has display data stored therein and the display RAM is electrically connected to the display part 401 to transmit a control signal to the display part 401 to cause the display data to be displayed thereon. The display control part 407 is electrically connected to the bus 409 to enable the display control from the CPU 410.

The external terminal 400 also includes a USB controller 408. The USB controller 408 is a controller device to execute the voltage conversion process and the impedance conversion process such that peripherals each can execute communication with the CPU 410 through the USB interface. In the example shown in FIG. 5, the printer 1 is connected to the USB controller 408 through the USB cable 9 that is attached to the host socket 419, and the operational part 402 is also connected to the USB controller 408. The USB controller 408 and the bus 409 are electrically connected to each other such that the CPU 410 can detect the operation content of the operational part 402 and the printer 1 and the CPU 410 can communicate with each other.

<Features of this Embodiment>

In the above, the features of this embodiment are a disclosure of the cooling control that is executed on the basis of the temperature of the deriving motor detected by the temperature sensor 151 (hereinafter, properly referred to simply as "motor temperature"). Especially, in this embodiment, in addition to the execution of forcible cooling same as that of the ordinary technique of discontinuing the print formation and the feeding immediately when the motor temperature reaches s forcible cooling temperature determined in advance, between-page cooling is executed in the print area between two adjacent pages when the motor temperature reaches a between-page cooling temperature that is lower than the forcible cooling temperature. The details thereof will sequentially be described in detail below.

<Cooling Control in Comparative Example>

The case where the printer 1 does not execute the between-page cooling and executes only the forcible cooling (the forcible cooling temperature=90 [° C.]) will be described as Comparative Example with reference to FIGS. 6A-6G.

FIG. 6A shows the state immediately after the start of the feeding of the roll paper sheet S. In the state shown therein, the tip of the roll paper sheet S exactly reaches the position of the thermal line head 112 and the printing of a print R (specifically, a print R1 in the first page) in accordance with the print data is started. The motor temperature in this case is, for example, 80 [° C.] and is lower than a cooling cancellation temperature (=85 [° C.]) described later.

FIG. 6B shows the state where the feeding of the roll paper sheet S is further advanced from the state thereof in FIG. 6A and the printing is in the course of printing of the print R1 in the first page. The motor temperature in this case is 81 [° C.] and is lower than the forcible cooling temperature of 90 [° C.] and, as a result, the forcible cooling is not executed (in FIG. 6B, simply represented as "DETERMINATION OK" and the same will hereinafter be applied).

FIG. 6C shows the state where the feeding of the roll paper sheet S is further advanced from the state thereof in FIG. 6B and the printing of the print R1 in the first page comes to an end (the state where the thermal line head 112 faces a non-print area E between two adjacent pages, that is, in this example, a non-print area E12 between the first page and the second page). The motor temperature in this case is 84 [° C.] and is increased by 4 [° C.] between the time when the printing of the print R1 in the first page is started and the time when this printing comes to an end, as above. The motor temperature is however lower than the forcible cooling temperature of 90 [° C.] and, as a result, the forcible cooling is still not executed.

FIG. 6D shows the state where the feeding of the roll paper sheet S is further advanced from the state thereof in FIG. 6C and the printing is in the course of printing of a print R2 in the second page. The motor temperature in this case is 86 [° C.] and is still lower than the forcible cooling temperature of 90 [° C.].

FIG. 6E shows the state where the feeding of the roll paper sheet S is further advanced from the state thereof in FIG. 6D and the printing of the print R2 in the second page comes to an end (the state where the thermal line head 112 faces a non-print area E23 between the second page and the third page). The motor temperature in this case is 88 [° C.] and is further increased by 4 [° C.] from the time when the printing of the print R1 in the second page is started to the time when this printing comes to an end, as above. The motor temperature is however still lower than the forcible cooling temperature of 90 [° C.] and, as a result, the forcible cooling is still not executed.

FIG. 6F shows the state where the feeding of the roll paper sheet S is further advanced from the state thereof in FIG. 6E and the motor temperature finally reaches 90 [° C.] in the course of the printing of a print R3 in the third page. The motor temperature becomes equal to the forcible cooling temperature of 90 [° C.] and, as a result, the feeding of the roll paper sheet S and the print formation by the thermal line head 112 are immediately discontinued (that is, the printing is stopped) and the forcible cooling is started (in FIG. 6F, simply represented as "DETERMINATION NG" and the same will hereinafter be applied).

When a certain time period elapses after the forcible cooling is started and the motor temperature is decreased to the cooling cancellation temperature (that is 85 [° C.] in this example) determined in advance, the printing discontinued as above is resumed. To avoid generation of any gap and any non-printed portion (any white line) in the middle of the content of the print currently formed (that is the print R3 in this example) when the printing is resumed, the printer 1 doubly forms the dots for the print line on the roll paper sheet S on which the dots are formed last immediately before the discontinuation of the printing when the printing is resumed (what-is-called connecting printing).

A gap and a stain in the middle of the content of the print currently formed (that is the print R3 in this example) may however be generated to degrade the print quality as shown in, for example, 6G even when the connecting printing is executed in resuming the printing as above.

<Cooling Control in Embodiment>

A behavior of cooling control in this embodiment executed by the printer 1 to avoid the above adverse effect will be described with reference to FIGS. 7A-7F. As above, in this embodiment, in addition to the forcible cooling same as above (the forcible cooling temperature=90 [° C.]), the between-page cooling is executed (the between-page cooling temperature of 85 [° C.] that is lower than the forcible cooling temperature of 90 [° C.] is used in this example).

Similarly to FIG. 6A, FIG. 7A shows the state immediately after the start of the feeding of the roll paper sheet S, where the tip of the roll paper sheet S reaches the position of the thermal line head 112 and the printing of the print R1 in the first page is started. The motor temperature in this case is, for example, 80 [° C.] and is lower than the cooling cancellation temperature (=85 [° C.]).

FIG. 7B shows the state where the feeding of the roll paper sheet S is further advanced from the state thereof in FIG. 7A and, similarly to the state in FIG. 6B, the printing is in the course of the printing of the print R1 in the first page. The motor temperature in this case is 81 [° C.] and is lower than the forcible cooling temperature of 90 [° C.]. As a result, the forcible cooling is not executed. The determination as to whether the motor temperature reaches the between-page cooling temperature is executed only at the timing at which the thermal line head 112 faces a non-print area between pages, and is not executed at the timing shown in FIG. 7B.

FIG. 7C shows the state where the feeding of the roll paper sheet S is further advanced from the state thereof in FIG. 7B and, similarly to the state in FIG. 6C, the printing of the print R1 in the first page comes to an end (the state where the thermal line head 112 faces the non-print area E12 between the first page and the second page). The motor temperature in this case is 84 [° C.] and is lower than the forcible cooling temperature of 90 [° C.]. As a result, the forcible cooling is still not executed. The thermal line head 112 faces the non-print area E12 and, as a result, the determination for the between-page cooling (the determination as to whether the motor temperature reaches the between-page cooling temperature of 85 [° C.]) is also executed while the motor temperature is 84 [° C.] and is lower than 85 [° C.]. As a result, similarly to the above, the between-page cooling is also not executed.

FIG. 7D shows the state where the feeding of the roll paper sheet S is further advanced from the state thereof in FIG. 7C and, similarly to the state in FIG. 6D, the printing is in the course of the printing of the print R2 in the second page. The motor temperature in this case is 86 [° C.] and is still lower than the forcible cooling temperature of 90 [° C.] (the determination for the between-page cooling temperature is not executed).

FIG. 7E shows the state where the feeding of the roll paper sheet S is further advanced from the state thereof in FIG. 7D and, similarly to the state in FIG. 6E, the printing of the print R2 in the second page comes to an end. The motor temperature in this case is 88 [° C.] and is still lower than the forcible cooling temperature of 90 [° C.]. As a result, the forcible cooling is still not executed. On the other hand, the thermal line head 112 faces the non-print area E23 between the second page and the third page and, as a result, the determination for the between-page cooling temperature is executed. The motor temperature of 88 [° C.] exceeds 85 [° C.] for the between-page cooling and, as a result, the feeding of the roll paper sheet S and the print formation by the thermal line head 112 are immediately discontinued at this timing (that is, the printing is stopped) and the between-page cooling is started (see "DETERMINATION NG" in FIG. 7E).

When a certain time period elapses after the between-page cooling is started and the motor temperature is decreased to the cooling cancellation temperature (that is 85 [° C.] in this example) determined in advance, the printing discontinued as above is resumed. With the between-page cooling, the cooling is executed in the state where the thermal line head 112 faces the non-print area E23 between two adjacent pages (between the second page and the third page in the above example). As a result, no gap and no stain in the print content as above are generated when the printing is resumed. As a result, the print quality is not degraded.

<Control Content>

The control executed on the basis of the printing process program by the CPU 231 of the printer 1 to realize the above technique will be described with reference to flowcharts shown in FIG. 8 and FIG. 9.

In the flow shown in FIG. 8, for example, an operator issues a printing start instruction through a proper operation on the operational part 402 of the external terminal 400 and, as a result, this flow is started. At step S100, the CPU 231 first initializes a variable nL representing the line number to "0".

At step S105, the CPU 231 subsequently determines whether the line number nL is greater than the total line number nLA of one page determined in advance (in other words, whether the printing is finished up to the last line in the one page that receives the print at the current time point). During the time period for the line number nL to be smaller than the total line number nLA, the determination executed at step S105 is not satisfied (S105: NO) and the control step moves to step S135.

At step S135, the CPU 231 executes printing for one line. The CPU 231 outputs a control signal to the roller driving circuit 244 to cause the driving motor to drive the platen roller 111 (in the forward direction) to feed the roll paper sheet S by an amount for one line, and also outputs the corresponding control signal to the head driving circuit 243 to drive the heat generating elements of the thermal line head 112 to execute print formation for the one line for the roll paper sheet S. The control step subsequently moves to step S140.

At step S140, the CPU 231 determines whether the motor temperature T of the driving motor detected by the temperature sensor 151 is higher than the forcible cooling temperature Ts (that is 90 [° C.] in this example). When T and Ts are T<Ts, the determination executed at step S140 is not satisfied (S140: NO), and the control step returns to step S105 to repeat the same steps. As a result, the flow from step S105 to step S135 to step S140 to step S105, and so on is repeated and, as a result, the print formation (the printing) on the basis of the print data is executed for one line by one line.

When the printing is completed up to the final line of the page during the above repetition, the line number nL becomes equal to or greater than the total line number nLA (that is, the state where the thermal line head 112 faces the non-print area E between a certain page and the succeeding page during a time period between the time when the printing for the certain page is completed and the time when the printing for the succeeding page is started). As a result, the determination executed at step S105 is satisfied (S105: YES) and the control step moves to step S110.

At step S110, the CPU 231 determines whether the page number nP of the pages for which the processing is completed by this time point is smaller than the total page number nPA determined in advance for printing (in other words, whether the printing for all the pages does not yet come to an end). During the time period for nP and nPA to be nP<nPA, the determination executed at step S110 is satisfied (step S110: YES) and the control step moves to step S115.

At step S115, the CPU 231 determines whether the motor temperature T of the driving motor is equal to or higher than the between-page cooling temperature Tp. The determination executed at step S105 is satisfied and, through the execution of step S110, step S115 is executed. As a result, the determination for the between-page cooling is executed every time the thermal line head 112 arrives in the non-print area E between two adjacent pages after the start of the printing.

When the motor temperature T does not yet reach the between-page cooling temperature Tp, the determination executed at step S115 is not satisfied (S115: NO) and the control step moves to step S125. Step S115 corresponds to the between-page cooling determination process described in the appended claims.

At step S125, the CPU 231 increments the variable nP that indicates the page number at this time point by one and the control step moves to step S130.

At step S130, the CPU 231 initializes the line number nL to "0". The control step subsequently returns to step S105 to subsequently repeat the same steps. As a result, the flow from step S105 to step S135 to step S140 to step S105, and so on is repeated to execute the print formation (the printing) on the basis of the print data for one line by one line. Every time the printing for the line number of all the lines in each of the pages comes to an end, the determination executed at step S105 is satisfied and the flow from step S110 to step S115 to step S125 to step S130 to step S105 and so on is concurrently executed.

During the time period for the printing to be executed incrementing the page number as above (sequentially advancing to a succeeding page), when the motor temperature T is equal to or higher than the between-page cooling temperature Tp in the state where the thermal line head 112 faces the non-print area E between a certain page and the succeeding page, the determination executed at step S115 is satisfied and the control step moves to step S120.

At step S120, the CPU 231 executes the cooling process (see FIG. 9 described later for the detailed steps). Step S120 corresponds to the second discontinuation control process described in the appended claims.

FIG. 9A shows the details of the cooling process executed at step S120. In FIG. 9A, in this cooling process, at step S200, the CPU 231 determines whether 1 second elapses. The determination executed at step S200 is not satisfied until the 1 second elapses (S200: NO) and the CPU 231 loop-stands by until this determination is satisfied. When the 1 second elapses, the determination executed at step S200 is satisfied (S200: YES) and the process step moves to step S210.

At step S210, the CPU 231 determines whether the motor temperature T of the driving motor exceeds the cooling cancellation temperature Tr (that corresponds to the between-page cooling cancellation temperature and the forcible cooling cancellation temperature, and that is 85 [° C.] in this example). During the time period for T and Tr to be T>Tr, the determination executed at step S210 is satisfied (S210: YES) and the process step returns to step S200 and the elapse of 1 second is waited for to repeat again step S210. During the repetition of the temperature measurement at the intervals of 1 second in this manner, when the motor temperature T of the driving motor is decreased to be equal to the cooling cancellation temperature Tr, the determination executed at step S210 is not satisfied (S210: NO) and the cooling comes to an end. The process step returns to step S125 of the flow in FIG. 8 to repeat the same steps as step S130 and thereafter.

Step S125 and step S130 executed after step S120 is executed correspond to the second resuming control process described in the appended claims.

The flow from step S105 to S135 to S140 to step S105 is repeated as above and, every time one page is finished, the flow from step S105 to step S110 to step S115 to (step S120) to step S125 to step S130 to step S105 and so on is repeated. When the printing for the previous page comes to an end and the page number nP exceeds the total page number nPA, the determination executed at step S110 is not satisfied (step S110: NO) and this flow is caused to come to an end.

The determination as to whether the motor temperature T reaches the between-page cooling temperature Tp is executed for each non-print area E between pages in accordance with the above flow and, as a result, the motor temperature T basically does not reach the forcible cooling temperature Ts that is higher than the between-page cooling temperature Tp. In the case, however, for example, where the motor temperature T is very slightly lower than the between-page cooling temperature Tp and the process step moves from step S115 to step S125 and the motor temperature T is subsequently equal to or higher than the forcible cooling temperature Ts in the middle of the succeeding page (during the time period for nL and nLA to be nL≤nLA) for a certain reason, the determination executed at step S140 is satisfied (S140: YES) and the process step moves to step S145. Step S140 corresponds to the forcible cooling determination process described in the appended claims.

At step S145, the CPU 231 executes the cooling process same as that in FIG. 9. The cooling process executed at step S145 executed as a result of the satisfaction of the determination executed at step S140 after the printing for the one line executed at step S135 is, as a result, executed in the state where the thermal line head 112 faces the print area (the area determined in advance as an area to have the print R formed therein) in each page. Step S145 corresponds to the first discontinuation control process described in the appended claims.

As described above with reference to FIG. 9A, in this cooling process, the CPU 231 repeats the temperature determination at intervals of 1 second at step S200 and step S210, and, when the motor temperature T of the driving motor is decreased to be equal to the cooling cancellation temperature Tr (S210: NO), causes the cooling to come to an end. The process step subsequently returns to the flow in FIG. 8 to move to step S150.

At step S150 in FIG. 8, the CPU 231 causes the printing to resume. In this case, the connecting printing is executed by executing a connecting driving process.

FIG. 9B shows the details of the connecting driving process executed at step S150. In FIG. 9B, in the connecting driving process, at step S220, the CPU 231 outputs a control signal to the roller driving circuit 244 to cause the driving motor to drive the platen roller 111 (in a reverse direction that is reverse to the forward direction) to transport the roll paper sheet S in the reverse direction for 10 lines.

At step S230, the CPU 231 subsequently outputs a control signal to the roller driving circuit 244 to cause the driving motor to drive the platen roller 111 (in the forward direction) to feed the roll paper sheet S in the forward direction for nine lines. The CPU 231 subsequently causes the connecting driving process to come to an end and the process step returns to step S105 in FIG. 8. Step S150 corresponds to the first resuming control process described in the appended claims. When the printing for one line is executed at step S135 after the process step returns to the flow in FIG. 8 due to the fact that the roll paper sheet S is reversely transported by one line (relative to the previous state) as above at each of step S220 and step S230, the printing can be resumed in the state where only one line overlaps on the portion printed last in the previously executed printing. Because of the flow from step S140 to step S145 to step S150 to step S105, and so on, even when the between-page cooling cannot be executed at the timing at which the thermal line head 112 faces the non-print area E for a certain reason, the worst-case event of breakage and durability degradation caused by the heating of the driving motor or the thermal line head 112 can reliably be avoided to be able to make assurance doubly sure by executing the forcible cooling at step S140.

The technique according to this embodiment also has the following meaning. With the technique of executing the cooling in accordance with the detection result of the temperature of the thermal line head 112, the behavior of the temperature increase of the thermal line head 112 associated with the elapse of time after the start of the printing variously differs in accordance with the content of the print data (whether the printing rate is high or low, whether the energy necessary for the formation is high or low). As a result, it is difficult to accurately estimate the behavior of the temperature increase and it is difficult to accurately start the cooling immediately before the last page (before the start of the printing for the last page) as above. This will be described in more detail with reference to FIG. 10A and FIG. 10B. FIG. 10A and FIG. 10B are each a graph showing the behavior of the temperature of the printing head associated with the progress of the printing, with the axis of abscissa representing the printing distance (or the time period).

FIG. 10A shows an example of the behavior of the temperature increase of the thermal line head 112 in the case where the thermal line head 112 prints the print R (that includes prints R1, R2, R3, and R4 each including characters "cafe cafe cafe" in this example) on each of the pages from the first page to the fourth page of the roll paper sheet S.

When printing of the characters "cafe", that is, printing with a low printing rate is executed for all the pages as shown in FIG. 10A, the amount of generated heat from the thermal line head 112 is relatively small and the temperature increase rate per page is low. The temperature property shows a mildly positively sloped straight line as shown. As a result, the printing for a total of four pages from the first page to the fourth page is enabled during the time period during which the temperature of the thermal line head 112 reaches the cooling temperature after the printing is started at the shown cooling cancellation temperature.

On the other hand, FIG. 10B shows an example of the behavior of the temperature increase acquired when the thermal line head 112 prints the print R in another form (that includes prints R1 and R4 each including a text "cafe cafe cafe" and prints R2 and R3 each including an image of three blackened coffee cups, in this example) on each of the pages from the first page to the fourth page of the roll paper sheet S.

As shown in FIG. 10B, different from FIG. 10A, when printing of the images each including the three blackened coffee cups (that is, printing with a high printing rate) is executed in the course of the printing, the amount of generated heat from the thermal line head 112 is relatively large and the temperature increase rate per page is high. The temperature property during the printing for the second page becomes an extremely positively sloped property as shown. As a result, printing for a total of two pages of the first page and the second page can only be executed during the time period during which the head temperature reaches the cooling temperature after the start of the printing at the shown cooling cancellation temperature.

As above, the behavior of the temperature increase of the thermal line head 112 variously differs in accordance with the content of the print data and it is difficult to accurately estimate the behavior of the temperature increase.

In contrast, in this embodiment, the between-page cooling is executed in accordance with the detection result of the motor temperature T of the driving motor (not the thermal line head 112) as above. Different from the thermal line head 112, as to the driving motor, the temperature increase associated with the elapse of time after the start of the printing is relatively stable and it is easy to estimate the behavior of the temperature increase. This will be described in more detail with reference to FIG. 11A and FIG. 11B. FIG. 11A and FIG. 11B are each a graph showing the behavior of the temperature of the driving motor associated with the progress of the printing, with the axis of abscissa representing the printing distance (or the time).

In accordance with the above example, FIG. 11A shows an example of the behavior of the temperature increase of the thermal line head 112 in the case where the thermal line head 112 prints the print R (that includes the prints R1, R2, R3, and R4 each including the characters "cafe cafe cafe") on each of the pages from the first page to the fourth page, similarly to the above. FIG. 11B shows an example of the behavior of the temperature increase acquired when the thermal line head 112 prints the print R in the other form (that includes the prints R1 and R4 each including the text "cafe cafe cafe", and R2 and R3 each including the image of the three blackened coffee cups) on each of the pages from the first page to the fourth page.

As can be seen from the comparison between FIG. 11A and FIG. 11B, the temperature of the driving motor is increased showing a stable behavior in accordance with the increase of the number of the pages regardless of the level of the printing rate. In this example, in both cases, the printing for the first page, the second page, and the third page can reliably be executed during the time period during which the motor temperature reaches the cooling temperature after the printing is started at the shown cooling cancellation temperature. In this manner, different from the case of the thermal line head 112, as to the behavior of the temperature increase of the driving motor, the temperature increase associated with the elapse of time after the start of the printing is relatively stable and it is easy to estimate the behavior of the temperature increase.

In this embodiment, especially, the between-page cooling temperature Tp and the cooling cancellation temperature Tr are each set as a fixed value (each to be 85 [° C.]). The values of the between-page cooling temperature Tp (=85 [° C.]) and the cooling cancellation temperature Tr (=85 [° C.]) are each stored in a proper memory (for example, the EEPROM 235).

Modification Example

The present disclosure is not limited to the embodiment and various modifications can be made thereto within the scope not departing from the gist and the technical idea thereof. Such modification examples will sequentially be described below.

(1) Case where Between-Page Cooling Temperature Tp is Set to be Variable

The between-page cooling temperature Tp is fixedly set to be 85 [° C.] as above in the embodiment while the setting of this temperature is not limited to this and this temperature may be set to be variable. For example, a modification example where the between-page cooling temperature Tp is set to be variable applying thereto correction in accordance with the variation of the motor temperature associated with the execution of the printing (more specifically, in accordance with the temperature increase rate of the motor temperature T for each page) will be described with reference to FIG. 12 that corresponds to FIG. 7. The components equivalent to those in the embodiment are given the same reference numerals and will not again be described or will simply be described.

The behavior of the cooling control executed by the printer 1 in this modification example will be described with reference to FIGS. 12A-12E.

Similarly to FIG. 7A, FIG. 12A shows the state immediately after the start of the feeding of the roll paper sheet S, and the tip of the roll paper sheet S reaches the position of the thermal line head 112 and the printing of the print R1 in the first page is started. The motor temperature in this case is, for example, 80 [° C.] and is lower than the cooling cancellation temperature (=85 [° C.]).

FIG. 12B shows the state where the feeding of the roll paper sheet S is further advanced from the state in FIG. 12A and, similarly to FIG. 7C, the printing of the print R1 in the first page comes to an end (the state where the thermal line head 112 faces the non-print area E12 between the first page and the second page). The motor temperature in this case is increased from the above by 2 [° C.] to be 82 [° C.] (that is, the temperature increase difference ΔT=2 [° C.] for the immediately previous one page) and is lower than the forcible cooling temperature of 90 [° C.]. As a result, the forcible cooling is not executed. The thermal line head 112 faces the non-print area E12 and, as a result, the determination as to the between-page cooling (the determination as to whether the motor temperature reaches the between-page cooling temperature Tp) is also executed while the between-page cooling temperature Tp in this case is (variably) determined using the forcible cooling temperature Ts and the immediately previous temperature increase difference ΔT in accordance with the following.

$$Tp=Ts-\Delta T \quad \text{Eq. (1)}$$

In this case, Ts is Ts=90 [° C.] (a fixed value) and the immediate previous ΔT is ΔT=2 [° C.]. As a result, Tp is set as follows.

$$Tp = 90 - 2 = 88[° \text{ C.}]$$

The motor temperature is 82 [° C.] as above and is lower than Tp that is Tp=88 [° C.] and, as a result, the between-page cooling is also not executed.

FIG. 12C shows the state where the feeding of the roll paper sheet S is further advanced from the state in FIG. 12B and, similarly to the state in FIG. 7E, the printing of the print R2 in the second page comes to an end (the state where the thermal line head 112 faces the non-print area E23 between the second page and the third page). The motor temperature in this case is further increased from the above by 3 [° C.] to be 85 [° C.] (that is, the temperature increase difference ΔT for the immediately previous one page is ΔT=3 [° C.]) and is lower than the forcible cooling temperature of 90 [° C.]. As a result, the forcible cooling is not executed. The thermal line head 112 faces the non-print area E23 and, as a result, the determination for the between-page cooling (the determination as to whether the motor temperature reaches the between-page cooling temperature Tp) is also executed. Similarly to the above, the between-page cooling temperature Tp in this case is set as follows using the forcible cooling temperature Ts and the immediately previous temperature increase difference ΔT.

$$Tp = Ts - \Delta T = 90 - 3 = 87[° \text{ C.}]$$

The motor temperature is 85 [° C.] and is lower than Tp that is Tp=87 [° C.] and, as a result, the between-page cooling is still not executed.

FIG. 12D shows the state where the feeding of the roll paper sheet S is further advanced from the state in FIG. 12C and, similarly to the state in FIG. 7E, the printing is in the course of the printing of R3 in the third page. The motor temperature in this case is 86 [° C.] and is continuously lower than the forcible cooling temperature of 90 [° C.] (the determination as to the between-page cooling temperature is not executed).

FIG. 12E shows the state where the feeding of the roll paper sheet S is further advanced from the state in FIG. 12D and the printing of the print R3 in the third page comes to an end (the state where the thermal line head 112 faces a non-print area E34 between the third page and the fourth page). The motor temperature in this case is further increased from the state in FIG. 12C by 4 [° C.] to be 89 [° C.] (that is, the temperature increase difference ΔT in the immediately previous one page is ΔT=4 [° C.]) and is lower than the forcible cooling temperature that is 90 [° C.]. As a result, the forcible cooling is not executed. The thermal line head 112 faces the non-print area E34 and, as a result, the determination for the between-page cooling (the determination as to whether the motor temperature reaches the between-page cooling temperature Tp) is also executed. Similarly to the above, the between-page cooling temperature Tp in this case is set as follows using the forcible cooling temperature Ts and the immediately previous temperature increase difference ΔT.

$$Tp = Ts - \Delta T = 90 - 4 = 86[° \text{ C.}]$$

The motor temperature at this time point is 89 [° C.] as above and exceeds Tp that is Tp=86 [° C.] and, as a result, the feeding of the roll paper sheet S and the print formation by the thermal line head 112 are immediately discontinued at this timing (that is, the printing is stopped) and the between-page cooling is started (see "DETERMINATION NG" in FIG. 12E).

Assuming that the between-page cooling function is not equipped, the motor temperature T is lower than the forcible cooling temperature Ts that is 90 [° C.] in the state shown in FIG. 12E and, as a result, the printing for the fourth page is started and, immediately thereafter, the forcible cooling is abruptly started in the middle of the fourth page. As a result, the connecting printing is started. In this modification example, this can be avoided using the above technique.

<Control Content>

The control executed by the CPU 231 of the printer 1 of this modification example on the basis of the printing process program to realize the above technique will be described with reference to FIG. 13.

As shown in FIG. 13, in this modification example, step S101 is newly provided between step S100 and step S105 of the flow shown in FIG. 8 of the above embodiment, and step S106 and step S107 are newly provided between step S105 and step S110 thereof.

At step 101 after step S100 that is same as that in FIG. 8, the CPU 231 determines the motor temperature T of the driving motor detected by the temperature sensor 151 at this time point, as a page starting time temperature To.

Similarly to the above, the flow from step S105 to step S135 to step S140 to step S105, and so on is subsequently repeated and, as a result, the printing up to the last line of the page is completed during the time period during which the printing is executed one line by one line, to satisfy the determination executed at step S105. At this time, the process step moves to step S106 that is newly provided.

At step S106, the CPU 231 calculates the temperature difference between the motor temperature T of the driving motor at this time point (that is, the time when the printing for the page comes to an end) and the page starting time temperature To set at step S101, that is, the temperature increase difference ΔT (=T−To) by which the motor temperature T is increased during the printing for one page. The process step subsequently moves to step S107.

At step S107, the CPU 231 calculates the difference between the forcible cooling temperature Ts and the temperature increase difference ΔT calculated at step S106, and sets this difference to be the between-page cooling temperature Tp. Step S106 and step S107 correspond to a temperature correction process described in the appended claims.

Because of the setting of the between-page cooling temperature Tp at step S107, at step S115 after step S110, the determination as to whether the motor temperature reaches the between-page cooling temperature Tp is executed using the between-page cooling temperature Tp that is set (to be variable) at step S107 using the temperature increase difference ΔT.

The other steps are same as those of the flow in FIG. 8 and will not again be described.

The cooling cancellation temperature Tr is a fixed value in the above while the cooling cancellation temperature Tr may be set to be variable in accordance with the variation of the motor temperature similarly to the above.

(2) Others

The between-page cooling temperature Tp is automatically set in accordance with Eq. (1) with the correction applied thereto in accordance with the variation of the motor temperature in the setting of the between-page cooling temperature Tp used in the determination for the first between-page cooling and in the setting of each of all the between-page cooling temperatures Tp in the modification example while the setting is not limited to the above. The user may input the initial value of the between-page cooling temperature Tp through the proper operational buttons•keys and the like (an input part) disposed on the printer 1 and the CPU 231 may set the between-page cooling temperature to be variable applying thereto the correction in accordance with the variation of the motor temperature for the between-page cooling temperature Tp used thereafter, on the basis of the set initial value.

The temperature of the driving motor is directly detected by the temperature sensor 151 as the motor temperature detector disposed on the driving motor in the above while the temperature detection is not limited to the above. For example, a thermistor as the motor temperature detector may be disposed at a point somewhat distant from the driving motor (for example, on the control circuit board 170) and the forcible cooling temperature Ts may be determined in accordance with, for example, Eq. (2) below on the basis of the detected temperature (an environmental temperature Te; unit [° C.]) detected by the thermistor.

$$Ts=A\times Te+B \quad \text{(Eq. 2)}$$

The coefficient A and the constant B are experimentally determined and the coefficient A may be set to be, for example, 0.7 and the constant B may be set to be, for example, 33. As a result, the forcible cooling is started when the motor temperature reaches 26 [° C.] in a cold environment (for example, at −10 [° C.] or the like), and the forcible cooling is started when the motor temperature reaches 54 [° C.] in a hot environment (for example, at 30 [° C.] or the like).

The description has been made taking an example where the present disclosure is applied to the printer 1 that is driven by the battery power source as the printer in the above, while the application is not limited to this. The present disclosure may be applied to, for example, a printer that forms an image and prints characters on an ordinary print-receiving paper sheet (a print-receiving medium) having a size of A4, A3, B4, B5, or the like using a thermal head, or a print label producing device that produces a print label by executing desired printing for a roll paper sheet S using the thermal head 112, as an example of the printer.

In the above, arrows shown in the drawings such as FIG. 5 each indicate an example of the flow of a signal, and do not each limit the flow direction of the signal.

The flowcharts shown in FIG. 8, FIG. 9, FIG. 13, and the like do not limit the present disclosure to the steps shown in the flows, and any addition•deletion to/from, any change of order, or the like of the steps may be conducted within the scope not departing from the gist and the technical idea of the present disclosure.

In addition to the above, the techniques in accordance with the embodiment and the modification examples may be used properly in combination.

In addition, though not specifically exemplified, the present disclosure is implemented with various changes made thereto within the scope not departing from the gist thereof.

What is claimed is:

1. A printer comprising:

a feeding roller configured to feed a print-receiving medium that has plural pages arranged on the print-receiving medium along a length direction of the print-receiving medium, each of the pages including a print area, and has non-print areas each disposed between respective two adjacent pages of said plural pages;

a driving motor configured to drive said feeding roller; and a printing head including plural heat generating elements that is arranged along a direction perpendicular to a feeding direction of said feeding roller and is configured to form at least dots in each print line formed by dividing said print-receiving medium in said feeding direction at a print resolution, said printing head being configured to form a print on said print-receiving medium, the printer being configured to sequentially execute printing using said feeding roller and said printing head in cooperation with each other for each of said plural pages of said print-receiving medium, said printer further comprising:

a motor temperature detector configured to detect a temperature of said driving motor;

a processor; and a first memory, said first memory storing computer-executable instructions that, when executed by said processor, cause said printer to perform:

a forcible cooling determination process for determining whether a detected temperature detected by said motor temperature detector reaches a forcible cooling temperature predetermined in advance in a state that said printing head executes the printing on said print area;

a first discontinuation control process for discontinuing said printing to execute forcible cooling, by controlling said printing head and said feeding roller at a timing that it is determined that said detected temperature reaches said forcible cooling temperature by said forcible cooling determination process;

a first resuming control process for resuming said printing while doubly forming dots on said print line of said print-receiving medium on which dots are formed last at least immediately before discontinuing said printing by controlling said printing head and said feeding roller when said detected temperature is decreased to a forcible cooling cancellation temperature predetermined in advance after a start of an execution of said forcible cooling by said first discontinuation control process;

a between-page cooling determination process for determining whether said detected temperature reaches a between-page cooling temperature that is lower than said forcible cooling temperature in a state that said printing head faces said non-print area;

a second discontinuation control process for discontinuing said printing to execute between-page cooling, by controlling said printing head and said feeding roller in a state that said printing head faces said non-print area at a timing that it is determined that said detected temperature reaches said between-page cooling temperature by said between-page cooling determination process; and a second resuming control process for resuming said printing by controlling said printing head and said feeding roller when said detected temperature is decreased to between-page cooling cancellation temperature predetermined in advance after a start of an execution of said between-page cooling by said second discontinuation control process.

2. The printer according to claim 1, wherein said between-page cooling temperature and said between-page cooling cancellation temperature are each set to be a fixed value.

3. The printer according to claim 2, wherein said between-page cooling cancellation temperature and said forcible cooling cancellation temperature are temperatures common to each other.

4. The printer according to claim 2, further comprising a second memory configure to store said between-page cooling temperature and said between-page cooling cancellation temperature to be said fixed values stored therein, wherein in said between-page cooling determination process, whether said detected temperature reaches said between-page cooling temperature stored in said second memory is determined, and wherein in said second resuming control process, said printing is resumed when said detected temperature is decreased to said between-page cooling cancellation temperature stored in said second memory.

5. The printer according to claim 1, wherein said between-page cooling temperature and said between-page cooling cancellation temperature are each set to be variable.

6. The printer according to claim 5, wherein said memory stores instructions that, when executed by said processor, cause said printer to further perform:

a temperature correction process for setting said between-page cooling temperature to be variable by applying correction to the between-page cooling temperature in accordance with variation of the detected temperature detected by said motor temperature detector associated with execution of said printing, and wherein in said second discontinuation control process, said between-page cooling is executed on the basis of said between-page cooling temperature set to be variable by said temperature correction process.

7. The printer according to claim 6, further comprising an input device configured to be input with a manual setting for an initial value of said between-page cooling temperature, wherein in said temperature correction process, said between-page cooling temperature is set to be variable on the basis of said initial value set by said input device.

8. A non-transitory computer-readable recording medium, storing a printing process program to be readable for a computing device, for executing steps on the computing device provided in a printer that comprises a feeding roller configured to feed a print-receiving medium that has plural pages arranged on the print-receiving medium along a length direction of the print-receiving medium, each of the pages including a print area, and has non-print areas each disposed between respective two adjacent pages of said plural pages; a driving motor configured to drive said feeding roller; a printing head including plural heat generating elements that is arranged along a direction perpendicular to a feeding direction of said feeding roller and is configured to form at least dots in each print line formed by dividing said print-receiving medium in said feeding direction at a print resolution, said printing head being configured to form a print on said print-receiving medium; and a motor temperature detector configured to detect a temperature of said driving motor, and is configured to sequentially execute printing using said feeding roller and said printing head in cooperation with each other for each of said plural pages of said print-receiving medium, said steps comprising:

a forcible cooling determination step for determining whether a detected temperature detected by said motor temperature detector reaches a forcible cooling temperature predetermined in advance in a state that said printing head executes the printing on said print area;

a first discontinuation control step for discontinuing said printing to execute forcible cooling, by controlling said printing head and said feeding roller at a timing that it is determined that said detected temperature reaches said forcible cooling temperature in said forcible cooling determination step;

a first resuming control step for resuming said printing while doubly forming dots on said print line of said print-receiving medium on which dots are formed last at least immediately before discontinuing said printing, by controlling said printing head and said feeding roller when said detected temperature is decreased to a forcible cooling cancellation temperature predetermined in advance after a start of an execution of said forcible cooling in said first discontinuation control step;

a between-page cooling determination step for determining whether said detected temperature reaches a between-page cooling temperature that is lower than said forcible cooling temperature in a state that said printing head faces said non-print area;

a second discontinuation control step for discontinuing said printing to execute between-page cooling, by controlling said printing head and said feeding roller in a state that said printing head faces said non-print area at a timing that it is determined that said detected temperature reaches said between-page cooling temperature in said between-page cooling determination step; and a second resuming control step for resuming said printing by controlling said printing head and said feeding roller when said detected temperature is decreased to between-page cooling cancellation temperature predetermined in advance after a start of an execution of said between-page cooling in said second discontinuation control step.

* * * * *